US006017259A

United States Patent [19]

Motoi et al.

[11] Patent Number: 6,017,259

[45] **Date of Patent: *Jan. 25, 2000**

[54] METHOD OF MANUFACTURING ELECTRON-EMITTING DEVICE, ELECTRON SOURCE AND IMAGE-FORMING APPARATUS

[75] Inventors: Taiko Motoi; Takeo Tsukamoto; Sotomitsu Ikeda, all of Atsugi; Kumi Nakamura, Isehara; Toyoko Kobayashi; Naoko Miura, both of Kawasaki, all of Japan

[73] Assignee: Canon Kabushiki Kaisha, Tokyo, Japan

[21] Appl. No.: 08/732,789

[22] Filed: Oct. 15, 1996

[30] Foreign Application Priority Data

| | | | |
|---|---|---|---|
| Oct. 12, 1995 | [JP] | Japan | 7-289152 |
| Oct. 12, 1995 | [JP] | Japan | 7-289153 |
| Oct. 12, 1995 | [JP] | Japan | 7-289154 |
| Jun. 17, 1996 | [JP] | Japan | 8-175472 |
| Oct. 11, 1996 | [JP] | Japan | 8-287346 |

[51] Int. Cl.[7] ..... H01J 9/02

[52] U.S. Cl. ..... 445/51

[58] Field of Search ..... 445/24, 50, 51

[56] References Cited

U.S. PATENT DOCUMENTS

| | | | |
|---|---|---|---|
| 3,611,077 | 10/1971 | Smith | 315/94 |

FOREIGN PATENT DOCUMENTS

| | | | |
|---|---|---|---|
| 0660357 | 6/1995 | European Pat. Off. | H01J 1/30 |
| 0717428 | 6/1996 | European Pat. Off. | H01J 9/02 |
| 1112633 | 5/1989 | Japan | H01J 1/30 |
| 2247940 | 10/1990 | Japan | H01J 1/30 |
| 7235255 | 9/1995 | Japan | H01J 1/30 |
| 7325279 | 12/1995 | Japan | G02F 1/13 |
| 8-96699 | 4/1996 | Japan | H01J 1/30 |

OTHER PUBLICATIONS

Advances in Electronics and Electron Physics, vol. VIII, 1956, pp. 89–185, W.P. Dyke et al., "Field Emission".

Journal of Applied Physics, Dec. 1976, vol. 47, No. 12, pp. 5248–5263, C. A. Spindt et al. "Physical Properties of Thin–Film Field Emission Cathodes with Molybdenum Cones".

Journal of Applied Physics, vol. 32, Jan.–Dec. 1961, pp. 646–652, C. A. Mead, "Operation of Tunnel–Emission Devices".

Radio Engineering and Electronic Physics, Jul. 1965, pp. 1290–1296, M. L. Elinson et al., "The Emission of Hot Electroncs and the Field Emission of Electrons from Tin Oxide".

Thin Solid Films, 1972, pp. 317–328, G. Dittmer, "Electrical Conduction and Electron Emission of Discontinuous Thin Films".

International Electron Devices, 1975, pp. 519–521, M. Hartwell et al., "Strong Electron Emission From Patterned Tin–Indium Oxide Thin Films".

Journal of the Vacuum Society of Japan, vol. 26, No. 1, H. Araki et al., "Electroforming and Electron Emission of Carbon Thin Films".

*Primary Examiner*—Kenneth J. Ramsey

*Attorney, Agent, or Firm*—Fitzpatrick, Cella Harper & Scinto

[57] ABSTRACT

An electron-emitting device has a pair of device electrodes formed on a substrate, an electroconductive film connecting the device electrodes and an electron-emitting region formed in the electroconductive film. The electron-emitting device is manufactured by (1) applying an ink containing the material for producing the electroconductive film to a predetermined position of the substrate in the form of one or more than one drops by means an ink-jet apparatus, (2) drying and/or baking the applied drop(s) to turn the drop(s) into an electroconductive thin film and (3) applying a voltage to the pair of device electrodes to flow an electric current through the electroconductive film and produce an electron-emitting region. Steps (1) and (2) are so conducted that the electroconductive film formed by steps (1) and (2) have a latent image apt to produce an electron-emitting region by the Joule's heat generated by step (3).

33 Claims, 20 Drawing Sheets

METHOD OF MANUFACTURING ELECTRON-EMITTING DEVICE, ELECTRON SOURCE AND IMAGE-FORMING APPARATUS

BACKGROUND OF THE INVENTION

1. Field of the Invention

This invention relates to a method of manufacturing an electron-emitting device, an electron source and an image-forming apparatus comprising such an electron source and, more particularly, it relates to a method of manufacturing the same by means of an ink-jet technique.

2. Related Background Art

Two types of electron-emitting devices have been known; the thermoelectron emission type and the cold cathode electron emission type. Of these, the cold cathode emission type refers to devices including field emission type (hereinafter referred to as the FE type) devices, metal/insulation layer/metal type (hereinafter referred to as the MIM type) electron-emitting devices and surface conduction electron-emitting devices. Examples of FE type device include those proposed by W. P. Dyke & W. W. Dolan, "Field emission", Advance in Electron Physics, 8, 89 (1956) and C. A. Spindt, "PHYSICAL Properties of thin-film field emission cathodes with molybdenum cones", J. Appl. Phys., 47, 5248 (1976). Examples of MIM device are disclosed in papers including C. A. Mead, "Operation of Tunnel-Emission Devices", J. Appl. Phys., 32, 646 (1961).

Examples of surface conduction electron-emitting devices include one proposed by M. I. Elinson, Radio Eng. Electron Phys., 10, 1290, (1965).

A surface conduction electron-emitting device is realized by utilizing the phenomenon that electrons are emitted out of a small thin film formed on a substrate when an electric current is forced to flow in parallel with the film surface. While Elinson et al. proposes the use of $SnO_2$ thin film for a device of this type, the use of Au thin film is proposed in [G. Dittmer: "Thin Solid Films", 9, 317 (1972)] whereas the use of $In_2O_3/SnO_2$ thin film and that of carbon thin film are discussed respectively in [M. Hartwell and C. G. Fonstad: "IEEE Trans. ED Conf.", 519 (1975)] and [H. Araki et al.: "Vacuum", Vol. 26, No. 1, p. 22 (1983)].

FIG. 18 of the accompanying drawings schematically illustrates a typical surface conduction electron-emitting device proposed by M. Hartwell. In FIG. 18, reference numeral 1 denotes a substrate. Reference numeral 4 denotes an electroconductive thin film normally prepared by producing an H-shaped thin metal oxide film by means of sputtering, part of which is subsequently turned into an electron-emitting region 5 when it is subjected to a process of current conduction treatment referred to as "energization forming" as described hereinafter. In FIG. 18, a pair of device electrodes are separated from each other by a distance L of 0.5 to 1 mm and the central area of the electroconductive thin film has a width W' of 0.1 mm.

Apart from the above device, the applicant of the present patent application has proposed a surface conduction electron-emitting device prepared by arranging a pair of device electrodes and an electroconductive thin film on a substrate in different manufacturing steps as typically described in Japanese Patent Application Laid-Open No. 7-235255. FIGS. 19A and 19B schematically illustrate the proposed surface conduction electron-emitting device. The electroconductive thin film arranged between a pair of device electrodes 2 and 3 is preferably made from electroconductive fine particles in order to produce an electron-emitting region that operates in a desired manner. For instance, a film made from fine particles of palladium oxide PdO is preferably used for the electroconductive thin film.

Conventionally, an electron emitting region 5 is produced in a surface conduction electron-emitting device by subjecting the electroconductive thin film 4 of the device to a current conduction treatment which is referred to as "energization forming". In an energization forming process, a constant DC voltage or a slowly rising DC voltage that rises typically at a rate of 1V/min. is applied to given opposite ends of the electroconductive thin film 4 to partly destroy, deform or transform the film and produce an electron-emitting region 5 which is electrically highly resistive. Thus, the electron-emitting region 5 is part of the electroconductive thin film 4 that typically contains a fissure or fissures therein so that electrons may be emitted from the fissure and its vicinity. Note that, once subjected to an energization forming process, a surface conduction electron-emitting device comes to emit electrons from its electron emitting region 5 whenever an appropriate voltage is applied to the electroconductive thin film 4 to make an electric current run through the device.

With the above described energization forming process of producing an electron-emitting region, however, it is difficult to satisfactorily control the process, particularly in terms of where in the electroconductive thin film the electron-emitting region is produced and what profile it has so that, when a large number of electron-emitting devices are subjected to an energization forming process, the produced electron-emitting regions may vary from device to device in terms of the location in the electroconductive thin film and the profile. In some cases, the electron-emitting region can show a profile meandering between the device electrodes. Such variances in the location and profile are reflected in the electron-emitting performance of the devices so that the emission current Ie and the electron emission efficiency (the ratio of the emission current to the current flowing through the device If or $\eta$=Ie/If) can vary from device to device.

Thus, when a large number of electron-emitting devices are arranged on a substrate to form an image-forming apparatus, and a video signal is applied thereto to produce a uniform brightness, the emission current of the electron-emitting devices can vary from device to device to give rise to an image having irregular brightness, to the detriment of the performance of the apparatus.

Particularly, if the electron-emitting region of an electron-emitting device meanders to a large extent, the diameter of the electron beam emitted from it can expand to produce a large bright spot on the fluorescent film of the image-forming apparatus. Thus, when pixels are densely arranged at a high pitch in order to display finely defined images, the electron beam emitted from an electron-emitting device having a meandering electron-emitting region can partly irradiate one or more than one neighboring pixels to seriously degrade the quality of the displayed image.

The applicant of the present patent application has so far proposed several techniques that can bypass the above identified problem. For instance, Japanese Patent Application Laid-Open No. 1-112633 discloses a method of controlling the location of the electron-emitting region in an electron-emitting device by forming an electroconductive thin film of two electroconductive members having different melting points and forming subsequently an electron-emitting region at a position located along the border line of the two different electroconductive members. Japanese Patent Application Laid-Open No. 2-247940 discloses a technique of arranging a step-forming member at a position for producing an electron-emitting region and forming an electroconductive thin film across the step-forming member to produce a step there, along which an electron-emitting region is formed thereafter. Japanese Patent Application Laid-Open No. 8-96699 teaches a technique of using a pair of device electrodes having different film thicknesses and forming an electron-emitting region along an edge of the device electrode having the greater thickness. Finally, Japanese Patent Application Laid-Open No. 7-325279 teaches a technique of modifying the composition of part of the electroconductive thin film by irradiating it locally with a laser beam to increase the electric resistance there and turning it into an electron-emitting region by energization forming.

As described above, a number of methods have been proposed for controlling the electron-emitting region in terms of position and profile in the process of producing it by energization forming. All these methods are designed to modify part of the electroconductive thin film of an electron-emitting device in order to differentiate it compositionally from the remaining portion of the electroconductive thin film by means of a specifically designed technique such as the use of laser beam or a fine processing operation involving the use of a specifically designed member for producing a projection on the device or the use of a sharp edge formed on one of the device electrodes.

SUMMARY OF THE INVENTION

An object of the present invention is to provide a method of manufacturing an electron-emitting device, an electron source comprising a number of such devices and an image-forming apparatus using such an electron source at low cost with a reduced number of manufacturing steps.

Another object of the present invention is to provide a method of manufacturing electron-emitting devices on a mass production basis with an improved yield, an electron source comprising a number of such devices and an image-forming apparatus using such an electron source.

Still another object of the present invention is to provide a method of manufacturing electron-emitting devices that operate remarkably uniformly for electron emission, an electron source comprising a number of such devices and an image-forming apparatus using such an electron source.

A further object of the present invention is to provide a method of manufacturing an electron-emitting device capable of positionally controlling the formation of an electron-emitting region and a method of an electron source comprising a number of such devices and an image-forming apparatus using such an electron source.

According to the invention, the above objects are achieved by providing a method of manufacturing an electron-emitting device having a pair of device electrodes formed on a substrate, an electroconductive film connecting the device electrodes and an electron-emitting region formed in the electroconductive film characterized in that it comprises steps of:

(1) applying an ink containing the material for producing said electroconductive film to a predetermined position of the substrate in the form of one or more than one drops by means an ink-jet apparatus;

(2) drying and/or baking the applied drop(s) to turn the drop(s) into an electroconductive thin film; and (3) applying a voltage to the pair of device electrodes to cause an electric current to flow through said electroconductive film and produce an electron-emitting region; said steps (1) and (2) being so conducted that the electroconductive film formed by said steps (1) and (2) have a latent image apt to produce an electron-emitting region by Joule's heat generated by the step (3).

According to the invention, there is also provided a method of manufacturing an electron-emitting device having a pair of device electrodes formed on a substrate, an electroconductive film connecting the device electrodes and an electron-emitting region formed in the electroconductive film characterized in that it comprises a step including a process of producing an electroconductive film for forming an electron-emitting region by applying a solution containing the material of the electroconductive film to an area connecting said device electrodes in the form of drop(s) by means of an ink-jet system, and a step of producing an electron-emitting region in the electroconductive film for forming an electron-emitting region such that a latent image of the electron-emitting region is formed for the electron-emitting region in the electroconductive film during said process of applying the solution by means of an ink-jet system.

According to the invention, there is also provided a method of manufacturing an electron source comprising a substrate, a plurality of electron-emitting devices arranged on the substrate, each having a pair of oppositely disposed device electrodes, an electroconductive film connecting the device electrodes and an electron-emitting region formed in an area of the electroconductive film, and wires connecting the electron-emitting devices, characterized in that the electron-emitting devices are formed by a method as defined above.

According to the invention, there is also provided a method of manufacturing an image-forming apparatus comprising an electron source prepared by arranging a plurality of electron-emitting devices, each having a pair of oppositely disposed device electrodes, an electroconductive film connecting the device electrodes, and an electron-emitting region formed in an area of the electroconductive film, and wires connecting the electron-emitting devices on a substrate and an image-forming member adapted to emit light when irradiated with electron beams emitted from the electron source, said electron source and said image-forming member being arranged in a vacuum envelope, characterized in that the electron source is formed by a method as defined above.

DESCRIPTION OF THE PREFERRED EMBODIMENTS

The present invention utilizes some of the advantages of an ink-jet system to positionally control the formation of an electron-emitting region in an electron-emitting device.

A method of manufacturing a product comprising one or more than one electron-emitting devices preferably does not involve the use of fine processing operation from the viewpoint of cost reduction. For instance, the known patterning operation using a fine processing technique such as photolithography for producing an electroconductive thin film having a desired profile may be replaced by the operation of applying a solution containing a precursor of the electroconductive thin film to a substrate by means of an ink-jet apparatus and thereafter drying and heating the applied material. However, if the use of an ink-jet apparatus involves fine processing operation for controlling the precise location of the electron-emitting region, the advantages of an ink-jet system may probably be lost. Additionally, while device electrodes and wires may be formed in electron-emitting devices by printing or by means of an ink-jet apparatus, a sharp edge can hardly be produced on the device electrode by such a technique unlike the case of using fine processing operation.

As described above, any of the known techniques of positionally controlling the formation of an electron-emitting region cannot feasibly be used with a method of manufacturing an electron-emitting device by means of an ink-jet apparatus.

Thus, there is a demand for a technique of positionally controlling the formation of an electron-emitting region in an electron-emitting device that can be used with a method of producing an electroconductive thin film, device electrodes and wires in an electron-emitting device.

The above demand is particularly remarkable in the field of manufacturing an electron source by arranging a large number of electron-emitting devices on a large substrate by means of an ink-jet apparatus because this manufacturing method is advantageous over a patterning method using photolithography in terms of the number of steps and the facilities require for the manufacture. This invention is achieved on the basis of the above observation. According to the invention, there is provided a method of producing an electroconductive thin film by applying one or more than one drops of the liquid material of the film to a substrate by means of an ink-jet apparatus, wherein a "latent image" of the electron-emitting region is formed in the energization forming process, as described earlier, in order to positionally control the formation of the electron-emitting region.

The drop applied to the substrate typically forms a substantially circular electroconductive film. The circular electroconductive film or its precursor that is a metal compound is referred to as a "dot" hereinafter. A dot may be formed by applying a single drop or a number of drops repeatedly to a same spot.

Figure 21A:
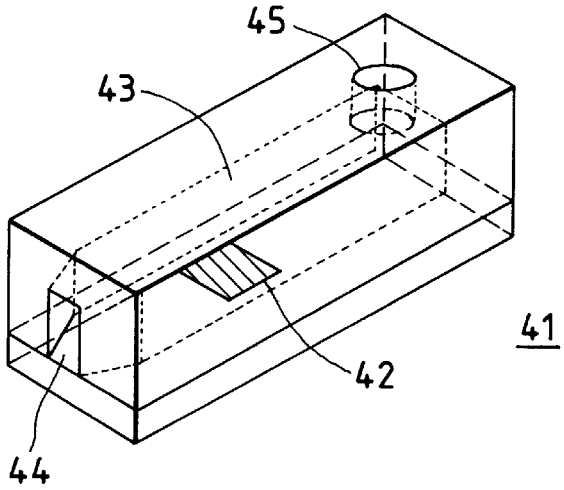
FIGS. 21A and 21B are schematic views of two different bubble jet heads that can be used for the purpose of the present invention.
Figure 21B:
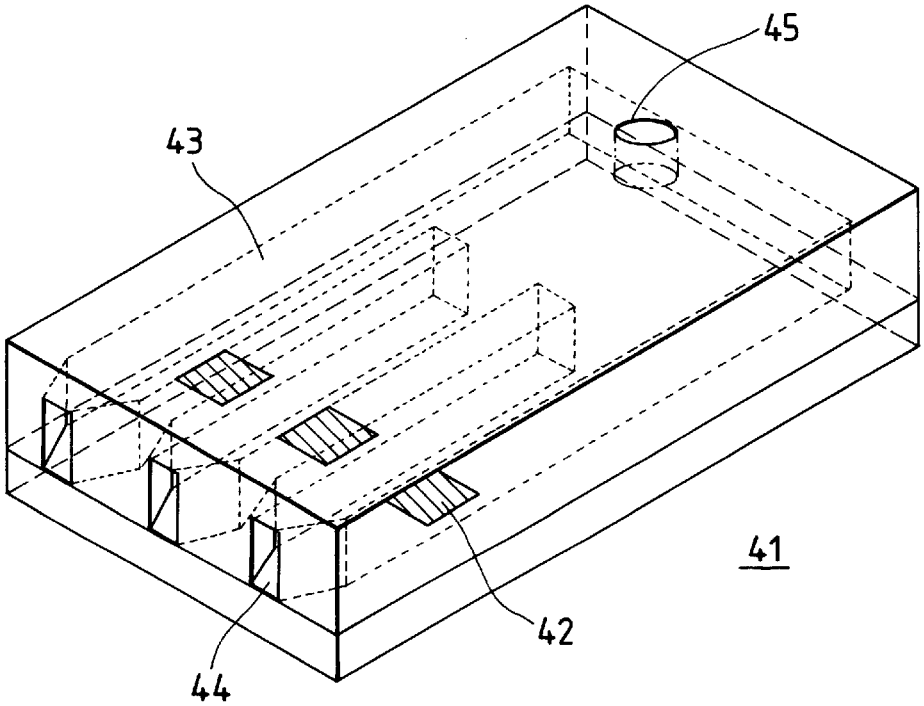

FIGS. 21A and 21B schematically illustrate two different ink-jet heads 41 that can be used with an ink-jet apparatus for the purpose of the invention. These heads are specifically adapted to bubble jets (BJ). FIG. 21A shows a head having a single discharge nozzle 44 and FIG. 21B shows a head having a plurality of laterally arranged discharge nozzles 44.

The solution of the material of the electroconductive film is heated by a heater 42 arranged along the solution conduit 43 leading to the nozzle 44 to instantaneously generate bubbles, which force a given amount of the material solution to be discharged from the nozzle in the form of drops, each weighing several nanograms to tens of several nanograms.

Alternatively, a piezo-jet system that discharges drops of solution by utilizing the deforming effect of a piezoelectric device may be used for the purpose of the invention.

In FIGS. 21A and 21B, reference numeral 45 denotes a solution feed pipe connected to a solution storage tank (not shown) for continuously feeding the head 41 with the material solution.

The invention provides several different ways for forming an electroconductive film on an electron-emitting device by means of an ink-jet system, which will be described below.

According to a first aspect of the invention, a plurality of dots are formed to bridge a pair of device electrodes and produce an electroconductive film having a varying film thickness so that an area of the film having a relatively small thickness may be used for a latent image of the electron-emitting region.

Figure 1A:
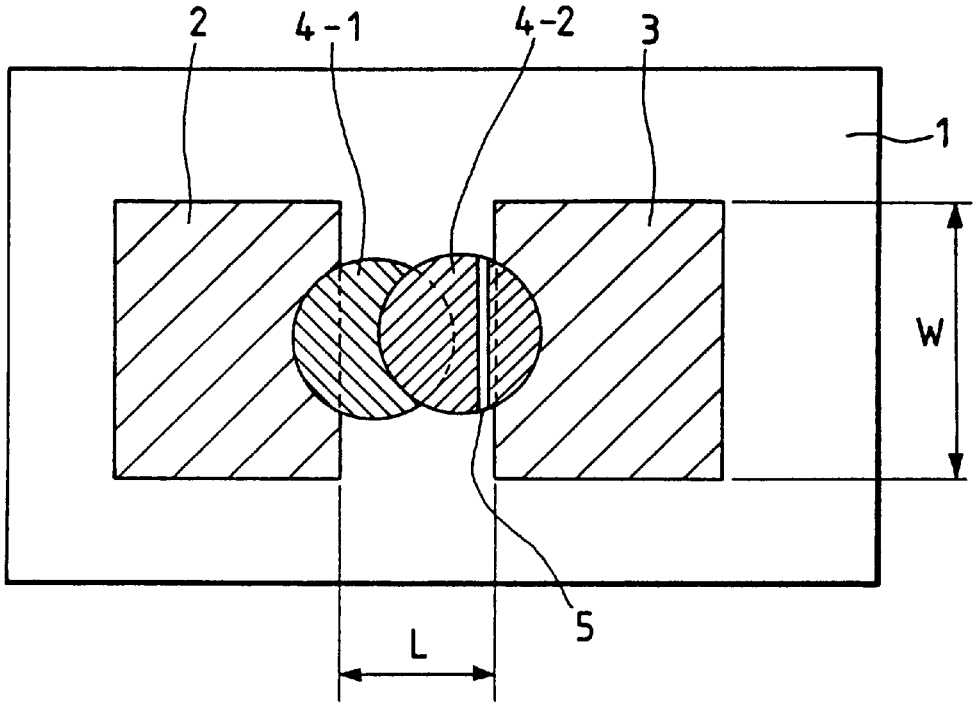
FIGS. 1A and 1B are schematic views of a first electron-emitting device realized by applying the present invention.
Figure 1B:
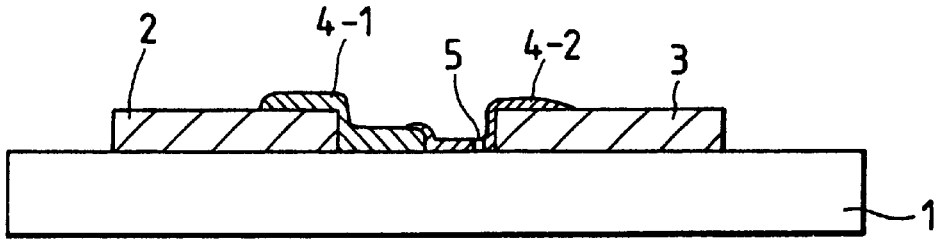
Figure 2A:
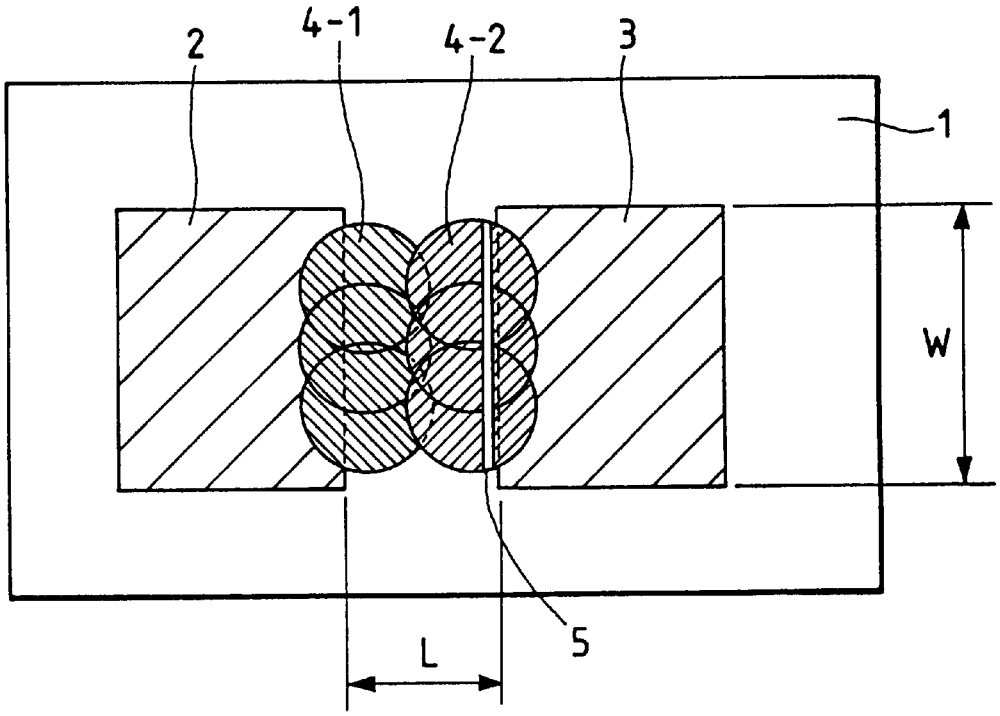
FIGS. 2A and 2B are schematic views of a second electron-emitting device realized by applying the present invention.
Figure 2B:
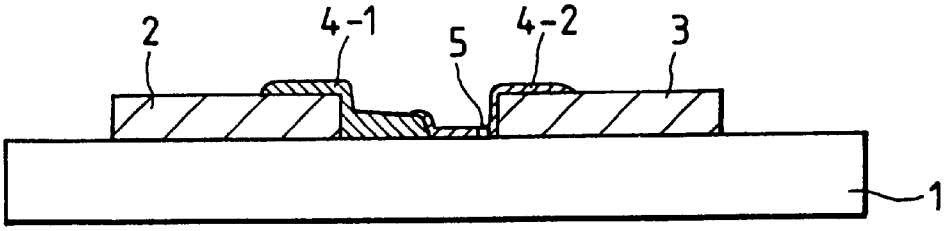
Figure 3A:
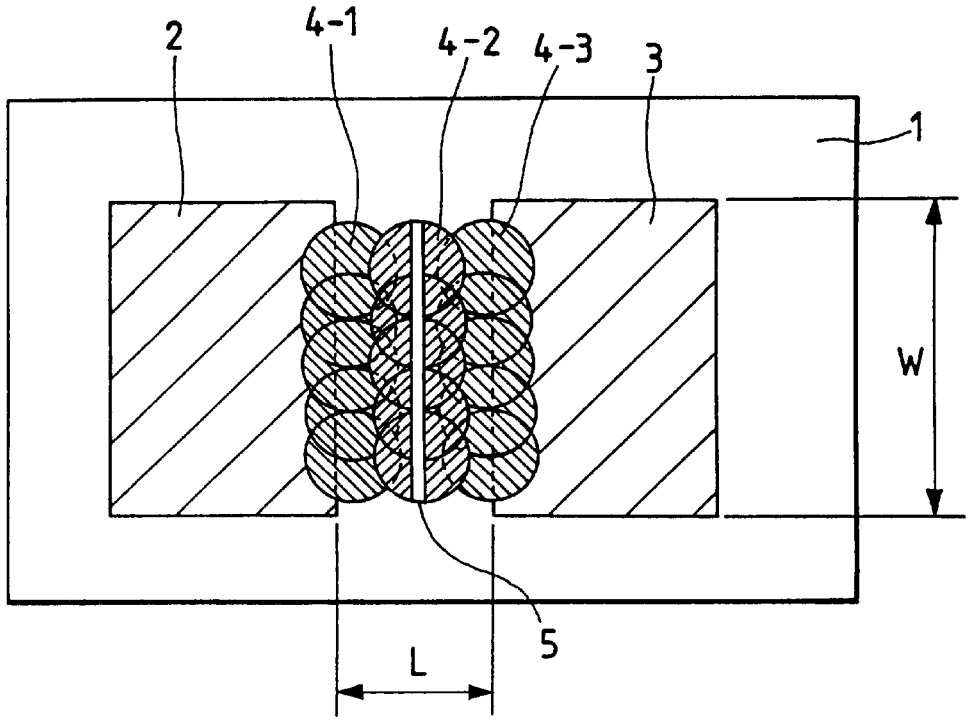
FIGS. 3A and 3B are schematic views of a third electron-emitting device realized by applying the present invention.
Figure 3B:
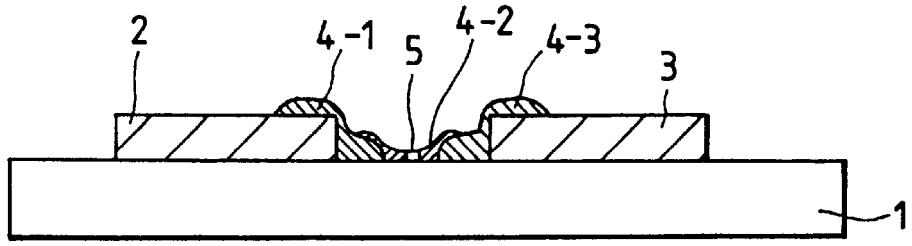

The latent image may be located close to one of the device electrodes as shown in FIGS. 1A, 1B, 2A and 2B or in the middle of the gap between the device electrodes as shown in FIGS. 3A and 3B.

An electroconductive film having a varying film thickness can be produced either by controlling the number of times of applying drops of the material solution on a same spot or by applying drops of the material solution with varied concentrations of the film forming metal compound.

It should be noted that, while drops having a same concentration of the film forming metal compound may be applied continuously to produce dots 4-1 or 4-2 of FIG. 2A for an electroconductive film with a varying film thickness, drops having different concentrations as indicated by dots 4-1 and 4-2 in FIG. 1A should not be applied continuously. In the latter instance, it is necessary that either dot 4-1 or 4-2 be formed by applying a drop and, after drying or baking the drop of the dot, the other dot is produced by applying a drop. The reason for this is that, if two drops with different concentrations are applied successively before the preceding drop sufficiently dries, the two drops may be mixed with each other to damage the object of producing a latent image. Also note that this theorem of avoiding mixture of drops of different concentrations applies elsewhere in the following description.

Figure 4A:
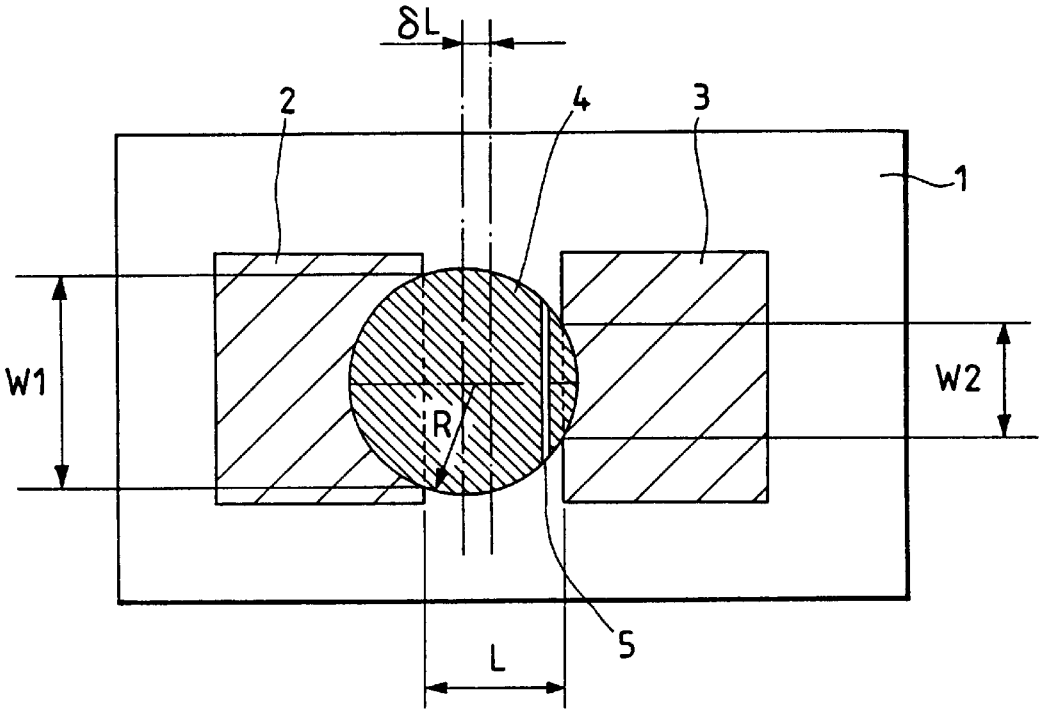
FIGS. 4A and 4B are schematic views of a fourth electron-emitting device realized by applying the present invention.
Figure 4B:
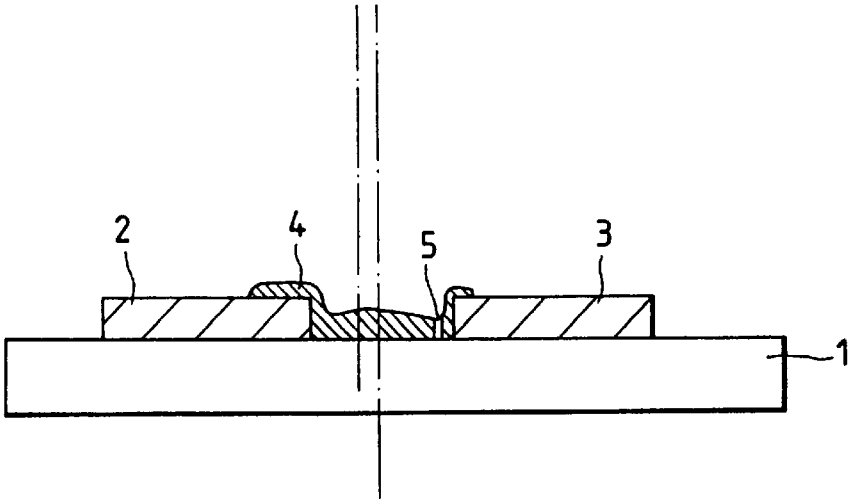

According to a second aspect of the invention, the electron-emitting region can be positionally controlled by utilizing the difference in the current density that may arise from a profile of the dot subjected to energization forming. According to this aspect of the invention, a dot is formed, with its center located not exactly in the middle of the gap separating the device electrodes but biased to either one of the device electrodes, so that the electroconductive film covers an edge of one of the device electrodes more than a corresponding edge of the other device electrode as shown in FIGS. 4A and 4B. With this arrangement, the current density will be greater at the edge having a smaller film coverage than at the edge having a larger film coverage in the energization forming process, so that an electron-emitting region is apt to be formed along the former edge. While the distribution pattern of film thickness of an electroconductive film cannot be defined in a simple manner because it is subject to various parameters, the film becomes thicker at the center of the dot and thinner in peripheral areas under appropriately selected conditions. Therefore, the positional arrangement of the electron-emitting region can be accurately controlled by selecting appropriate conditions for the dot forming process.

As a result of a series of preliminary studies, it has been found that the electron-emitting region of an electron-emitting device can be formed along an edge of one of the paired device electrodes with certainty if the electroconductive film has widths at the corresponding edges of the device electrodes that satisfy the following relationship.

$$(w_1/w_2) \geqq 2$$

where $w_1$ and $w_2$ are the widths of the electroconductive film at the corresponding edges of the device electrodes 2 and 3.

While the film coverage may not show any significant difference between the oppositely disposed edges of the device electrodes when a plurality of partially overlapping dots are formed along the edges, the effect of producing an electron-emitting region along either one of the edges can be realized by appropriately differentiating the overlapped areas of the dots.

According to a third aspect of the invention, the electron-emitting region can be positionally controlled by increasing the resistivity of a part of the electroconductive film, and using the part having a relatively large resistivity for producing a latent image.

Techniques that can be used to produce a part having a relatively large resistivity include that of applying a drop of a solution of a hardly oxidizable metal and that of a solution of an easily oxidizable metal to produce a dot of the hardly oxidizable metal and that of the oxide of the easily oxidizable metal, that of applying drops of two solutions of a same metal having different thermal decomposabilities to produce a dot of the metal and that of the oxide of the metal by appropriately controlling the thermal decomposition process, and that of applying drops of two different solutions of two different metals to produce partly overlapping dots so that an alloy of the metals having a resisivity greater than that of either metal is produced in that area (for instance, dots of Ni and Cr can produce an alloy of nickel and chromium, or nichrome, having a resistivity greater than that of Ni and that of Cr in the overlapping area).

In the following description, an area of electroconductive film that is made apt to produce an electron-emitting region in an energization forming process by reducing the film thickness or the film width is referred to as a "structural latent image", whereas an area of electroconductive film that is made apt to produce an electron-emitting region in an energization forming process by raising the resistivity is referred to as a "compositional latent image".

While a part of an electroconductive film may be made to appear like a latent image by a patterning process involving the use of known fine processing technologies, a method according to the invention has the following advantage over such a known patterning process, in addition to the fact that the former is simpler and less costly in terms of the number of steps and the apparatus for producing a latent image.

When a known patterning technique involving fine processing is used for the operation of differentiating the thickness of the dots on a substrate to produce an electron-emitting region in an electroconductive film according to the first aspect of the invention or that of applying drops of the solutions of different materials to produce an electron-emitting region in an electroconductive film according to the third aspect of the invention, part of the electroconductive film or that of the film of the precursor has to be subjected to a patterning operation in the first place, and subsequently either a mask for a lift-off operation has to be formed thereon or an etching operation for patterning the film additionally formed thereon has to be carried out. Then, in order for the above described series of operations to be carried out successfully, a number of requirements have to be met, including that the first film has to be strongly adherent to the substrate and that the second film layer formed on the first film layer has to be selectively etched, which by turn imposes a number of restrictions on the material of the electroconductive film. Contrary to this, a method according to the invention and involving the use of an ink-jet apparatus does not involve such restrictions and therefore can provide a wide variety of candidate materials. In other words, a method according to the invention is applicable to various different combinations of materials for the electroconductive film.

Now, the present invention will be described by referring to FIGS. 1A and 1B through 6A and 6B, which illustrate electron-emitting devices realized by using a method according to the invention.

Referring to FIGS. 1A and 1B, the device comprises a substrate 1, a pair of device electrodes 2 and 3, an electroconductive film 4 (4-1 and 4-2) and an electron-emitting region 5.

Materials that can be used for the substrate 1 include quartz glass, glass containing impurities such as Na to a reduced concentration level, soda-lime glass, glass substrate realized by forming an $SiO_2$ layer on soda lime glass by means of sputtering and ceramic substances such as alumina as well as Si substrate.

While the oppositely arranged device electrodes 2 and 3 may be made of any highly conducting material, preferred candidate materials include metals such as Ni, Cr, Au, Mo, W, Pt, Ti, Al, Cu and Pd and their alloys, printable conducting materials made of a metal or a metal oxide selected from Pd, Ag, Au, $RuO_2$, Pd—Ag and glass, transparent conducting materials such as $In_2O_3$—$SnO_2$ and semiconductor materials such as polysilicon. The distance L separating the device electrodes, the length W of the device electrodes, and other factors for designing a surface conduction electron-emitting device according to the invention may be determined depending on the application of the device. The distance L separating the device electrodes is preferably between hundreds of nanometers and hundreds of micrometers and, still preferably, between several micrometers and tens of several micrometers.

The length W of the device electrodes is preferably between several micrometers and hundreds of several micrometers depending on the resistance of the electrodes and the electron-emitting characteristics of the device. The film thickness d of the device electrodes 2 and 3 is between tens of several nanometers and several micrometers.

A surface conduction electron-emitting device according to the invention may have a configuration other than the one illustrated in FIGS. 1A and 1B and, alternatively, it may be prepared by sequentially laying an electroconductive film 4 and oppositely disposed device electrodes 2 and 3 on a substrate 1.

The electroconductive film 4 is preferably made of fine particles in order to provide excellent electron-emitting characteristics. The thickness of the electroconductive film 4 is determined as a function of the stepped coverage of the electroconductive film on the device electrodes 2 and 3, the electric resistance between the device electrodes 2 and 3, and the parameters for the energization forming process that will be described later as well as other factors and preferably between hundreds of several picometers, and is hundreds of several nanometers and more preferably between a nanometer and fifty nanometers. Note that, when a structural latent image is formed in a part of the electroconductive film having a film thickness differentiated from that of the rest of the electroconductive film, the film thickness of that part has to be made smaller than that of the rest of the electroconductive film and, at the same time, can fall under the above defined lower limit value. The electroconductive film 4 normally shows a sheet resistance Rs between $10^2$ and $10^7$ $\Omega/\square$, where Rs is defined by equation $R=Rs(1/w)$, R being the electric resistance of a film having a thickness of t, a width of w and a length of 1. $Rs=\rho/t$ if the resistivity $\rho$ of the film is constant and not variable depending on the location in the film.

With any of the above described methods according to the invention, the Rs of the latent image needs to be greater than that of the rest of the electroconductive film except the method according to the second aspect of the invention (although the Rs may be greater in the latent image than in the rest of the electroconductive film for the method according to the second aspect of the invention) and can exceed the above defined upper limit value.

For the purpose of the invention, materials that can be used for the electroconductive film 4 include metals such as Pd, Pt, Ru, Ag, Au, Ti, In, Cu, Cr, Fe, Zn, Sn, Ta, W and Pd and oxides of metals such as PdO, $SnO_2$, $In_2O_3$, PbO and $Sb_2O_3$.

The term a "fine particle film" as used herein refers to a thin film constituted of a large number of fine particles that may be loosely dispersed, tightly arranged or mutually and randomly overlapping (to form an island structure under certain conditions). The diameter of fine particles to be used for the purpose of the present invention is between hundreds of several picometers and hundreds of several nanometers, and preferably between a nanometer and twenty nanometers.

Since the term "fine particle" is frequently used herein, it will be described in greater depth below.

A small particle is referred to as a "fine particle" and a particle smaller than a fine particle is referred to as an "ultrafine particle". A particle smaller than an "ultrafine particle" and constituted by several hundred atoms is referred to as a "cluster".

However, these definitions are not rigorous and the scope of each term can vary depending on the particular aspect of the particle to be dealt with. An "ultrafine particle" may be referred to simply as a "fine particle" as in the case of this patent application.

"The Experimental Physics Course No. 14: Surface/Fine Particle" (ed., Koreo Kinoshita; Kyoritu Publication, Sep. 1, 1986) describes as follows:

"A fine particle as used herein refers to a particle having a diameter somewhere between 2 to 3 $\mu$m and 10 nm and an ultrafine particle as used herein means a particle having a diameter somewhere between 10 nm and 2 to 3 nm. However, these definitions are by no means rigorous and an ultrafine particle may also be referred to simply as a fine particle. Therefore, these definitions are a rule of thumb in any means. A particle constituted of two to several hundred atoms is called a cluster." (Ibid., p. 195, 11.22–26)

Additionally, "Hayashi's Ultrafine Particle Project" of the New Technology Development Corporation defines an "ultrafine particle" as follows, employing a smaller lower limit for the particle size:

"The Ultrafine Particle Project (1981–1986) under the Creative Science and Technology Promoting Scheme defines an ultrafine particle as a particle having a diameter between about 1 and 100 nm. This means an ultrafine particle is an agglomerate of about 100 to $10^8$ atoms. From the viewpoint of atom, an ultrafine particle is a huge or ultrahuge particle." (Ultrafine Particle—Creative Science and Technology: ed., Chikara Hayashi, Ryoji Ueda, Akira Tazaki; Mita Publication, 1988, p. 2, 11.1–4) "A particle smaller than an ultrafine particle and constituted by several to several hundred atoms is referred to as a cluster." (Ibid., p. 2, 11.12–13)

Taking the above general definitions into consideration, the term "a fine particle" as used herein refers to an agglomerate of a large number of atoms and/or molecules having a diameter with a lower limit between hundreds of several picometers and one nanometer and an upper limit of several micrometers.

The electron-emitting region 5 is formed in part of the electroconductive film 4 and comprises an electrically highly resistive fissure, although its performance is dependent on the thickness, the quality and the material of the electroconductive film 4 and the energization forming process which will be described hereinafter. The electron-emitting region 5 may contain, in the inside, electroconductive fine particles with a diameter between hundreds of several picometers and tens of several nanometers that may contain part or all of the elements of the material of the electroconductive film 4. Additionally, the electron-emitting region 5 and neighboring areas of the electroconductive film 4 may contain carbon and one or more than one carbon compounds.

Now, a method of manufacturing an electron-emitting device according to the invention will be described by referring to FIGS. 1A through 6B illustrating electron-emitting devices having different configurations and FIGS. 20A through 20G illustrating the steps of manufacturing an electron-emitting device.

Figure 20A:
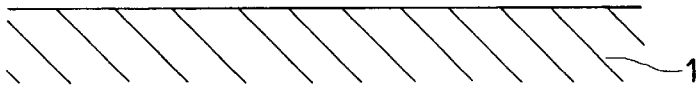
FIGS. 20A through 20G are schematic views illustrating different steps of a method of manufacturing an electron-emitting device according to the invention.
Figure 20B:
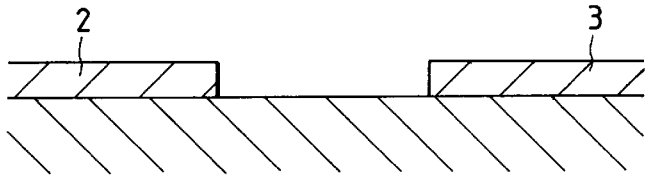

1) After thoroughly cleansing a substrate 1 with detergent and pure water (FIG. 20A), a pair of device electrodes 2 and 3 are formed on the substrate (FIG. 20B). Methods that can be used for producing the device electrodes include the one with which a pasty electroconductive material is applied to the substrate by printing to show a desired profile and then baked, the one with which a solution of a metal compound is applied to the substrate by means of an ink-jet apparatus to show a desired profile and heated to become an electroconductive substance and the one with which depositing a material on the substrate for the device electrodes by means of an appropriate technique selected from vacuum evaporation, sputtering etc. and giving them a predetermined profile typically by photolithography. Any of these methods can be selectively used depending on the application of the produced device and other considerations.

2) Thereafter, a material for the electroconductive film is applied to the substrate in the form of one or more than one drops of the material by means of an appropriate drop applicator means such as an ink-jet apparatus (the material to be applied as one or more than one drops is referred to as "electroconductive film producing ink" hereinafter). While the electroconductive film producing ink may be used in any form so long as it can be applied to the substrate by a drop applicator means, a dispersive solution containing fine particles of an electroconductive material such as one of the above listed metals or a solution of a metal compound (using water or an organic solvent for the solvent) may preferably be used.

When the electroconductive film is made of a metal, an alloy or a metal compound, the metal content of the electroconductive film producing ink is preferably between 0.01 and 5 wt %, although the appropriate range of the content may vary depending on the metal involved or the type of the metal compound. If the content is too low, a large number of drops of the ink have to be applied to the substrate to produce an electroconductive film having a desired film thickness to consequently consume a long operation time and make it difficult to produce an electroconductive film having a desired profile. If the content is too high, the produced electroconductive film can show an uneven film thickness, making it difficult to precisely control the electron-emitting performance of the device.

Firstly, techniques that can be used for forming a structural latent image will be described.

FIGS. 1A and 1B are schematic views of an electroconductive film realized in the form of a pair of dots having different film thicknesses that partly overlap one on the other. Two electroconductive film producing inks with different metal contents may be used so that the dot having a greater film thickness may be produced from the ink having a higher metal content, whereas the dot having a smaller film thickness may be produced from the ink having a lower metal content. Alternatively, the film thickness of the dots may be differentiated by applying different numbers of drops of a same ink.

Figure 20C:
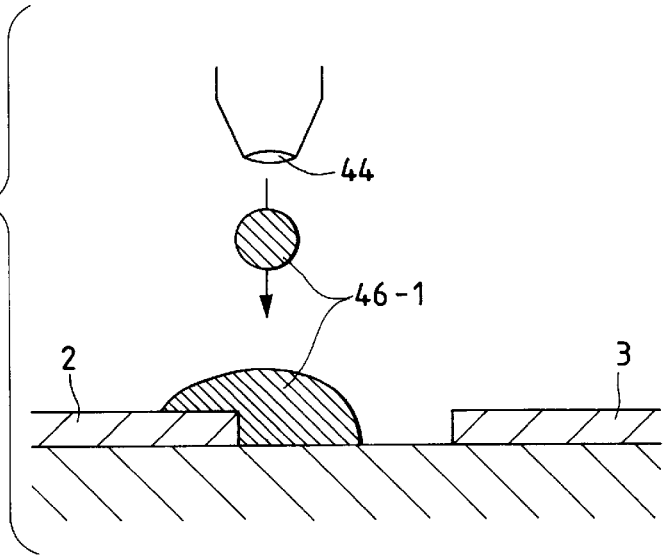
Figure 20D:
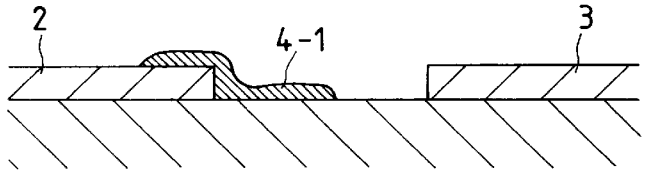
Figure 20E:
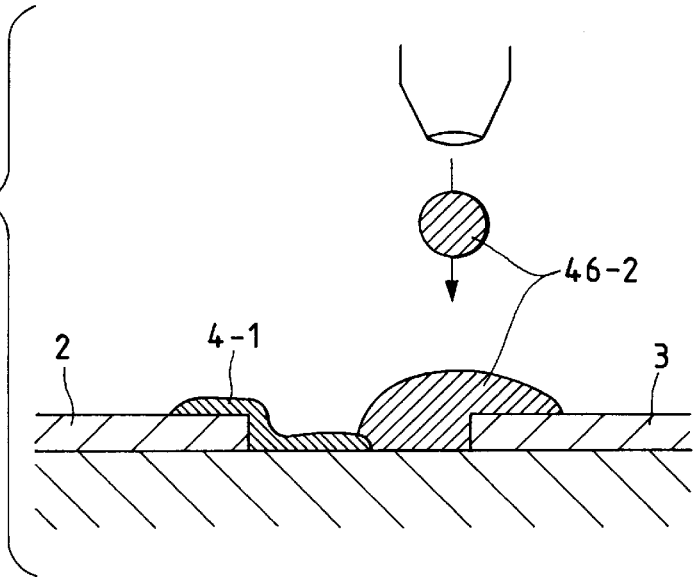

The manufacturing steps of FIGS. 20C through 20E correspond to the device of FIGS. 1A and 1B. A drop 46-1 of the ink with a higher metal content is discharged from the discharge nozzle 44 of an ink-jet apparatus to the substrate in such a way that it partly covers one of the device electrodes, or device electrode 2 (FIG. 20C). Thereafter, the drop is baked to produce a dot 4-1 of electroconductive film having a greater film thickness (FIG. 20D).

Figure 20F:
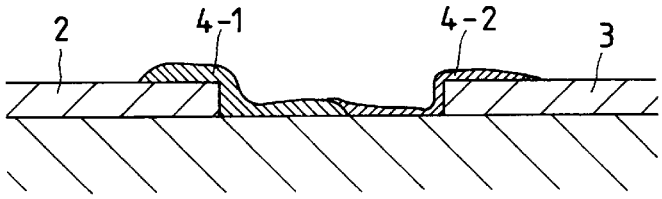

Subsequently, a drop 46-2 of the ink with a lower metal content is discharged to the substrate (FIG. 20E) in such a way that it partly covers the other device electrode, or device electrode 3 and overlaps the drop 4-1 (FIG. 20F). Note, however, the first drop may not be baked but only dried in the initial stages and may be baked after applying the second drop to produce an electroconductive film depending on the type of the ink.

The above procedures of applying inks with different metal contents may be followed for any of the other techniques of the invention.

Referring to FIGS. 1A and 1B, the dot located close to the device electrode 3 has a smaller film thickness, and an electron-emitting region or a structural latent image is apt to be produced there particularly in an area along or adjacent to the related edge of the device electrode 3 that can show a particularly small film thickness when the ratio of the thickness of the device electrode and that of the electroconductive film. The arrangement of FIGS. 2A and 2B is similar to that of FIGS. 1A and 1B and differs from the latter only in that the electroconductive film is formed to show a large width.

As a result of a preliminary study for looking into the positional controllability of the electron-emitting region as a function of the difference of film thickness between the thick film portion and the thin film portion, it was found that the electron-emitting region can be positionally rigorously controlled when the thick film portion has a film thickness more than twice greater than that of the thin film portion, although this difference may not provide an absolute condition for the control of the electron-emitting region because the region can be positionally controlled with a ratio smaller than 2:1 depending on the materials and the profiles of the substrate, the device electrode and the electroconductive film.

FIGS. 3A and 3B show an electron-emitting device having dots with a small film thickness arranged along the center line of the gap separating the device electrodes. The dots can be formed by the above described technique.

FIGS. 4A and 4B show an electron-emitting device having a relatively large dot with its center displaced to the side of the device electrode 2 from the center line of the gap separating the device electrodes. Since the dot of electroconductive film has a small width along the related edge of the device electrode 3, an electron-emitting region is most probably formed along this edge. If the dot has a radius of R, the gap separating the device electrodes is L and the center of the dot is displaced from the center line of the gap separating the device electrodes is L, the width $w_1$ of the electroconductive film along the related edge of the device electrode 2 and the width $w_2$ of the electroconductive film along the corresponding edge of the device electrode 3 will be expressed by the following equations.

$$w_1 = \sqrt{R^2 - \left(\frac{L}{2} - \delta L\right)^2}$$

$$w_2 = \sqrt{R^2 - \left(\frac{L}{2} + \delta L\right)^2}$$

The requirement for producing an electron-emitting region along the edge of the device electrode 3 with certainty is $(w_1/w_2) = \geqq 2$, which can be expressed as follows.

$$\sqrt{\frac{R^2-\left(\frac{L}{2}-\delta L\right)^2}{R^2-\left(\frac{L}{2}+\delta L\right)^2}} \geq 2$$

Thus, a value satisfying the above requirement should be selected for δL.

When a plurality of dots are arranged perpendicularly along a line connecting the device electrodes in a partially overlapped manner, a value satisfying the above requirement for a pair of dots should be selected for δL.

Now, techniques that can be used for forming a compositional latent image will be described.

Figure 5A:
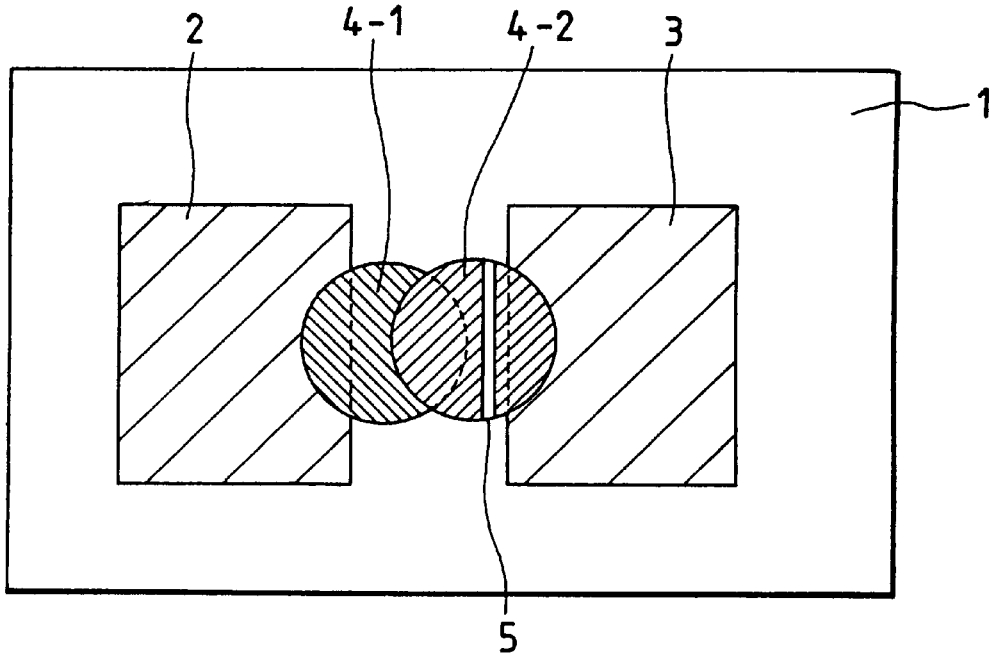
FIGS. 5A and 5B are schematic views of a fifth electron-emitting device realized by applying the present invention.
Figure 5B:
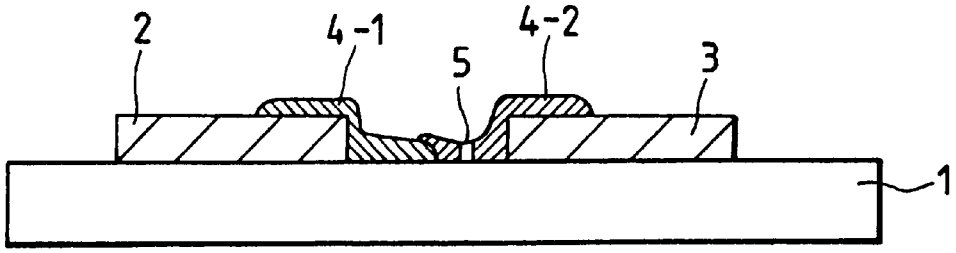

FIGS. 5A and 5B are schematic views of an electroconductive film realized in the form of a plurality of dots arranged along a line connecting a pair of device electrodes, which dots subsequently become a portion with a relatively low resistance 4-1 and a portion with a relatively high resistance 4-2 of electroconductive film after a baking process.

As described earlier, a number of different techniques can be used to differentiate the resistance of the two portions.

According to a first technique, the dots are formed by using an electroconductive film producing ink containing a hardily oxidizable metal and an electroconductive film producing ink containing an easily oxidizable metal to produce an electroconductive portion (4-1) made of the hardly oxidizable metal and an electroconductive portion (402) of the oxide of the easily oxidizable metal. For example, Pt and Pd may be selected respectively for the hardly oxidizable metal and the easily oxidizable metal to produce an electroconductive film comprising metal Pt and the oxide of Pd (PdO). The dots may be formed by using an electroconductive film producing inks containing compounds of the respective metals, which compounds may be thereafter thermally decomposed in an oxidizing atmosphere to produce the metal and the metal oxide. Alternatively, if the easily oxidizable metal is Pd, the Pd compound may be thermally decomposed in an oxidizing atmosphere to produce metal Pd, which is subsequently oxidized by heat treatment in an oxidizing atmosphere to produce PdO.

According to a second technique, electroconductive film producing inks containing different compounds of a common metal having different respective thermal decomposition temperatures are used and heat treated under appropriate conditions to produce the metal and the oxide of the metal. While both of the inks can produce the oxide of the metal if the heat treatment is conducted for a prolonged period of time, the compound of the metal having a lower thermal decomposition temperature is turned into the oxide of the metal whereas the other compound is treated to produce the metal and the treatment is completed before the produced metal is oxidized by selecting appropriate heating conditions.

According to a third technique (although the device has a configuration different from that of FIGS. 5A and 5B), a reducing agent is applied in advance by means of an ink-jet apparatus to part of the gap separating the device electrodes, e.g. locations close to the device electrodes, and an electroconductive film is formed thereon to cover the applied reducing agent and subsequently heat treated to reduce the metal compound to the metal on the areas of the reducing agent and produce the oxide of the metal in the remaining areas of the film. Thus, the electroconductive film comprises the metal in areas close to the device electrodes and the oxide of the metal which is a compositional latent image in a middle area.

Figure 6A:
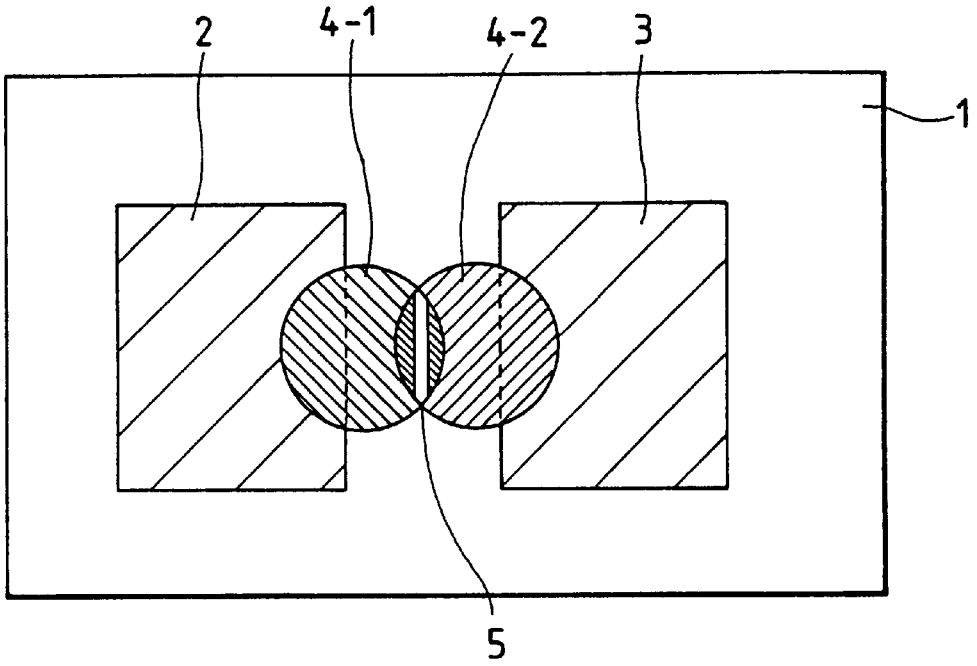
FIGS. 6A and 6B are schematic views of a sixth electron-emitting device realized by applying the present invention.
Figure 6B:
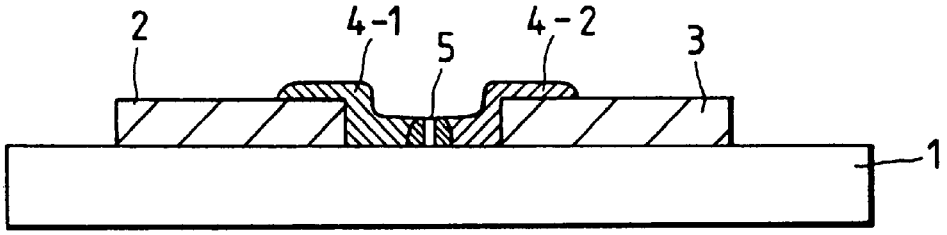

According to a fourth technique, dots of two different metals are formed in a partly overlapping manner as shown in FIGS. 6A and 6B to produce an alloy of the metals in the overlapping area of the dots (hereinafter referred to as "intersecting area") so that the resistance of the intersecting area becomes greater than that of the remaining areas. In order to positionally control the electron-emitting region to a satisfactory extent, the resistivity of the alloy produced in the intersecting area is made higher than the resistivity of the metal in the remaining areas by the magnitude of double digits.

Figure 20G:
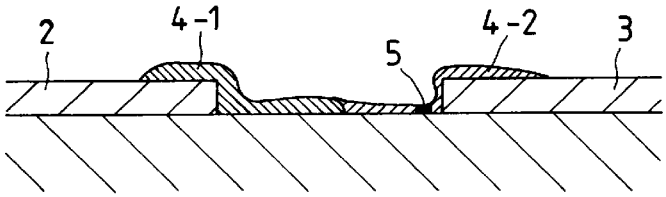

3) Thereafter, the device is subjected to a process referred to as "energization forming". For the purpose of the invention, energization forming is a process where a voltage is applied to the device electrodes to make an electric current flow through the electroconductive film formed in the above described process. As a voltage is applied to the device electrodes 2 and 3 from a power source (not shown), a structurally modified electron-emitting region 5 is formed in the area of the latent image in the electroconductive film 4. In other words, the electroconductive thin film 4 is locally and structurally destroyed, deformed or transformed to produce an electron emitting region 5 as a result of an energization forming process. In FIG. 20G, an electron-emitting region is produced in an area adjacent to the device electrode 3 where electroconductive film is thin, although the location and the structure of the latent image may be different from those illustrated in FIG. 20G depending on the technique employed to produce the latent image.

Figure 7A:
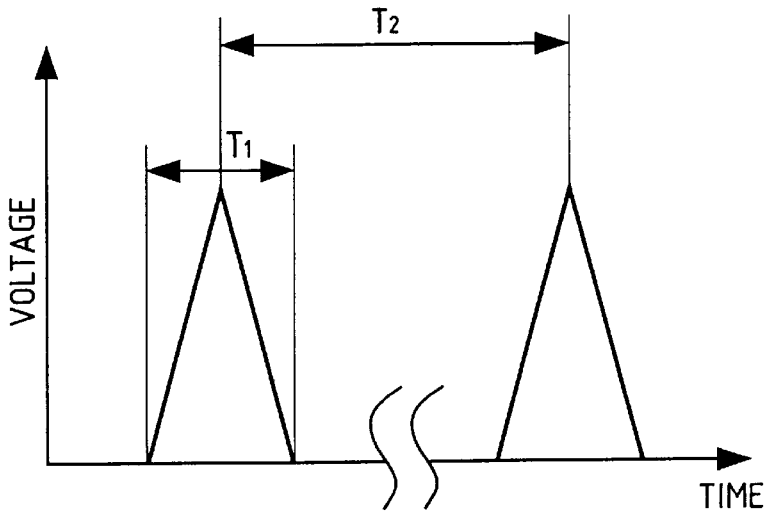
FIGS. 7A and 7B are graphs illustrating two different pulse voltage waveforms that can be used for energization forming for the purpose of the present invention.
Figure 7B:
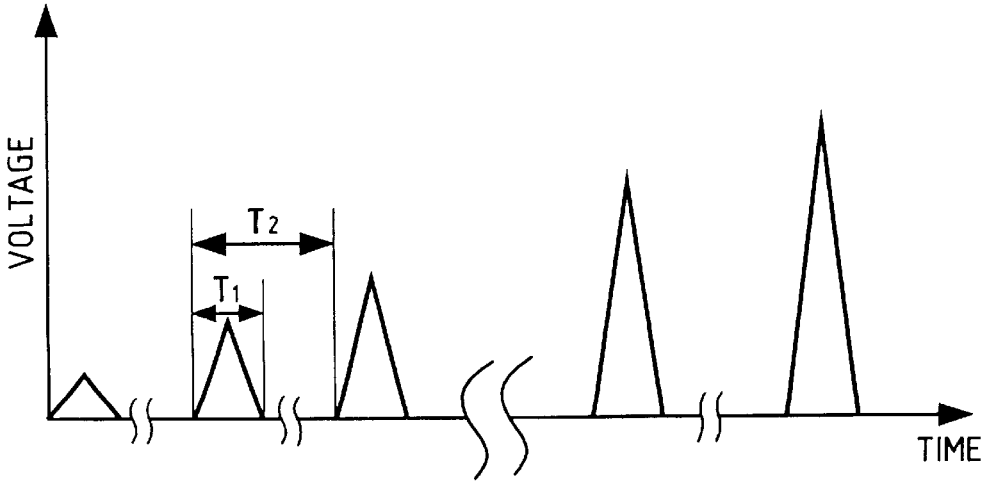

FIGS. 7A and 7B shows two different pulse voltages that can be used for energization forming.

The voltage to be used for energization forming preferably has a pulse waveform. A pulse voltage having a constant height or a constant peak voltage may be applied continuously as shown in FIG. 7A or, alternatively, a pulse voltage having an increasing height or an increasing peak voltage may be applied as shown in FIG. 7B.

In FIG. 7A, the pulse voltage has a pulse width $T_1$ and a pulse interval $T_2$, which are typically between 1 μsec. and 10 msec. and between 10 μsec. and 100 msec. respectively. The height of the triangular wave (the peak voltage for the energization forming operation) may be appropriately selected depending on the profile of the surface conduction electron-emitting device. The voltage is typically applied for between several seconds and tens of several minutes under the above conditions. Note, however, that the pulse waveform is not limited to triangular and a rectangular or some other waveform may alternatively be used.

FIG. 7B shows a pulse voltage whose pulse height increases with time. In FIG. 7B, the pulse voltage has an width $T_1$ and a pulse interval $T_2$ that are substantially similar to those of FIG. 7A. The height of the triangular wave (the peak voltage for the energization forming operation) is increased at a rate of, for instance, 0.1V per step.

The energization forming operation will be terminated by measuring the current flowing through the device electrodes when a voltage that is sufficiently low and cannot locally destroy or deform the electroconductive film 4 is applied to the device during an interval $T_2$ of the pulse voltage. Typically the energization forming operation is terminated when a resistance greater than 1M ohms is observed for the device current running through the electroconductive thin film 4 while applying a voltage of approximately 0.1V to the device electrodes.

4) After the energization forming process, the device is subjected to an activation process. An activation process is a process by means of which the device current If and the emission current Ie are changed remarkably.

In an activation process, a pulse voltage may be repeatedly applied to the device as in the case of energization forming process, in an atmosphere of the gas of an organic substance. The atmosphere may be produced by utilizing the organic gas remaining in a vacuum chamber after evacuating the chamber by means of an oil diffusion pump or a rotary pump or by sufficiently evacuating a vacuum chamber by means of an ion pump and thereafter introducing the gas of an organic substance into the vacuum. The gas pressure of the organic substance is determined as a function of the application of the electron-emitting device to be treated, the profile of the vacuum chamber, the type of the organic substance and other factors. Organic substances that can be suitably used for the purpose of the activation process include aliphatic hydrocarbons such as alkanes, alkenes and alkynes, aromatic hydrocarbons, alcohols, aldehydes, ketones, amines, organic acids such as, phenols, carbonic acids and sulfonic acids. Specific examples include saturated hydrocarbons expressed by general formula $C_nH_{2n+2}$ such as methane, ethane, propane, etc., unsaturated hydrocarbons expressed by general formula $C_nH_{2n}$ such as ethylene and propylene, benzene, toluene, methanol, ethanol, formaldehyde, acetaldehyde, acetone, methylethylketone, methylamine, ethylamine, phenol, formic acid, acetic acid and propionic acid as well as mixtures of any of them. As a result of an activation process, carbon or a carbon compound is deposited on the device out of the organic substances existing in the atmosphere to remarkably change the device current Ie and the emission current Ie.

The activation process is terminated appropriately by observing the device current If and the emission current Ie. The pulse width, the pulse interval and the pulse wave height of the pulse voltage to be used for the activation may be appropriately selected.

For the purpose of the present invention, carbon and a carbon compound refer to graphite (including so-called HOPG, PG and GC, of which HOPG has a substantially perfect crystal structure, PG has a somewhat distorted crystal structure containing crystalline particles with a size of about 20 nm and GC has a more distorted crystal structure containing crystalline particles with a size of about 2 nm) and noncrystalline carbon (amorphous carbon, a mixture of amorphous carbon and fine graphite crystal) and the thickness of the deposit of such carbon or a carbon compound is preferably less than 50 nm and more preferably less than 30 nm.

5) The electron-emitting device obtained after the above described manufacturing steps is then preferably subjected to a stabilization process. This is a process for removing any organic substances remaining in the vacuum chamber. The vacuuming and exhausting equipment to be used for this process preferably does not involve the use of oil so that it may not produce any evaporated oil that can adversely affect the performance of the device treated by this process. Thus, the use of a sorption pump or an ion pump may be a preferable choice.

If an oil diffusion pump or a rotary pump is used for the activation process and the organic gas produced by the oil is also utilized, the partial pressure of the organic gas has to be minimized by any means. The partial pressure of the organic gas in the vacuum chamber is preferably lower than $1.3\times10^{-6}$ Pa and more preferably lower than $1.3\times10^{-8}$ Pa so that no carbon or carbon compound may be additionally deposited. The vacuum chamber is preferably evacuated after heating the entire chamber so that organic molecules adsorbed by the inner walls of the vacuum chamber and the electron-emitting device in the chamber may also be easily eliminated. While the vacuum chamber is heated to 80 to 250° C., preferably above 150° C., for a period as long as possible, other heating conditions may alternatively be selected depending on the size and the profile of the vacuum chamber and the configuration of the electron-emitting device to be treated as well as other considerations. The pressure in the vacuum chamber needs to be made as low as possible and it is preferably lower than $1\times10^{-5}$ Pa and more preferably lower than $1.3\times10^{-6}$ Pa.

After the stabilization process, the atmosphere for driving the electron-emitting device or the electron source is preferably same as the one when the stabilization process is completed, although a lower pressure may alternatively be used without damaging the stability of operation of the electron-emitting device or the electron source if the organic substances in the chamber are sufficiently removed.

By using such an atmosphere, the formation of any additional deposit of carbon or a carbon compound can be effectively suppressed and $H_2O$, $O_2$ and other substances that have been absorbed by the vacuum chamber and the substrate can be eliminated to consequently stabilize the device current If and the emission current Ie.

The performance of an electron-emitting device prepared by way of the above processes, to which the present invention is applicable, will be described by referring to FIGS. 8 and 9.

Figure 8:
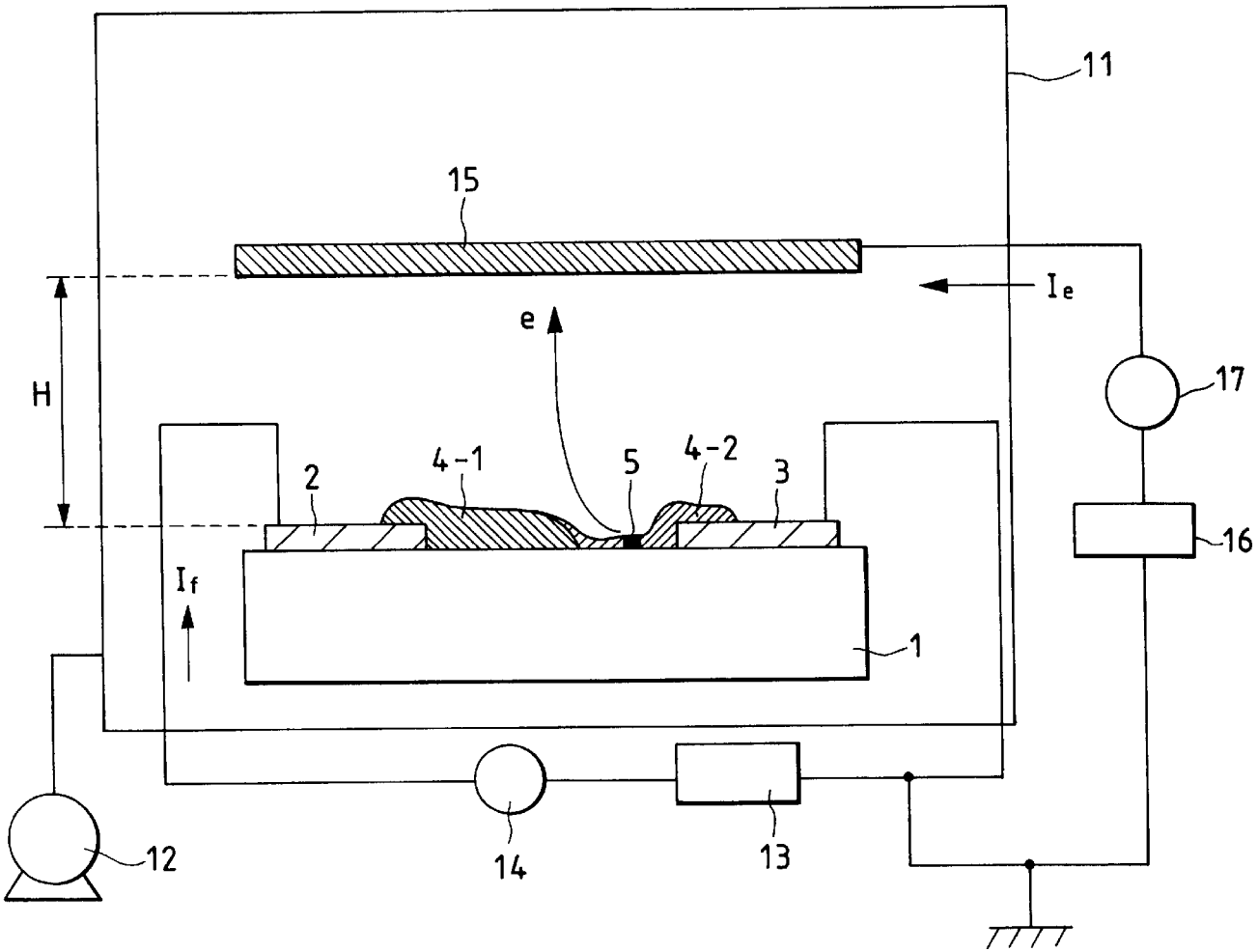
FIG. 8 is a schematic illustration of a gauging system to be used to evaluate the electron-emitting performance of an electron-emitting device manufactured by the method of the present invention.

FIG. 8 is a schematic block diagram of a vacuum processing apparatus comprising a vacuum chamber that can be used for the above processes. It can also be used as a gauging system for determining the performance of an electron emitting device of the type under consideration. In FIG. 8, the components of the electron-emitting device that are same as those of the devices in FIGS. 1A and 1B through 6A and 6B are denoted respectively by the same reference symbols. Referring to FIG. 8, the gauging system includes a vacuum chamber 11 and a vacuum pump 12. An electron-emitting device is placed in the vacuum chamber 11. The device comprises a substrate 1, a pair of device electrodes 2 and 3, an electroconductive film 4 and an electron-emitting region 5. Otherwise, the gauging system has a power source 13 for applying a device voltage Vf to the device, an ammeter 14 for metering the device current If running through the electroconductive film 4 between the device electrodes 2 and 3, an anode 15 for capturing the emission current Ie produced by electrons emitted from the electron-emitting re region of the device, a high voltage source 16 for applying a voltage to the anode 35 of the gauging system and another ammeter 17 for metering the emission current Ie produced by electrons emitted from the electron-emitting region 5 of the device. For determining the performance of the electron-emitting device, a voltage between 1 and 10 KV may be applied to the anode, which is spaced apart from the electron emitting device by distance H which is between 2 mm and 8 mm.

Instruments including a vacuum gauge and other pieces of equipment necessary for the gauging system are arranged in the vacuum chamber 11 so that the performance of the electron-emitting device or the electron source in the chamber may be properly tested. The vacuum pump 12 may be provided with an ordinary high vacuum system comprising a turbo pump or a rotary pump and an ultra-high vacuum system comprising an ion pump. The vacuum chamber containing an electron source therein can be heated by means of a heater (not shown). Thus, this vacuum processing apparatus can be used for the above described processes including the energization forming process and the subsequent processes.

Figure 9:
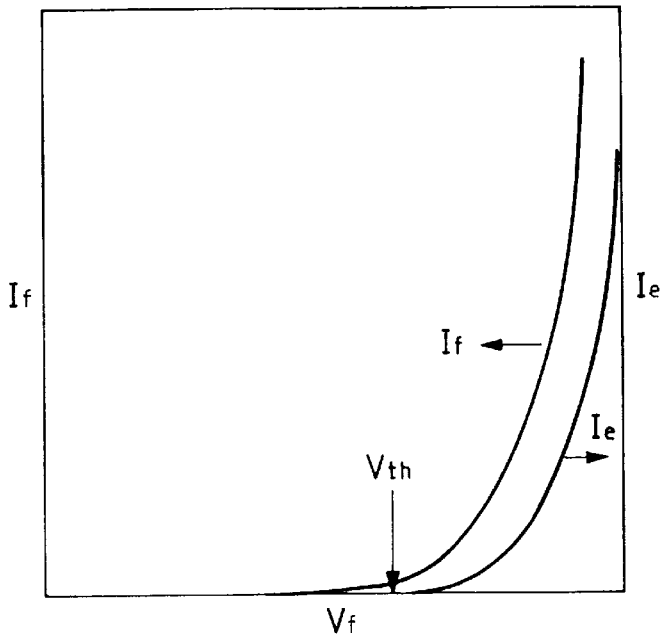
FIG. 9 is a graph showing the relationship between the device voltage Vf and the current If flowing through an electron-emitting device manufactured by the method of the present invention along with the relationship between the device voltage Vf and the emission current Ie of the device.

FIG. 9 shows a graph schematically illustrating the relationship between the device voltage Vf and the emission current Ie and the device current If typically observed by the gauging system of FIG. 8. Note that different units are arbitrarily selected for Ie and If in FIG. 9 in view of the fact that Ie has a magnitude by far smaller than that of If. Note that both the vertical and transversal axes of the graph represent a linear scale.

As seen in FIG. 9, an electron-emitting device according to the invention has three remarkable features in terms of emission current Ie, which will be described below.

(i) Firstly, an electron-emitting device according to the invention shows a sudden and sharp increase in the emission current Ie when the voltage applied thereto exceeds a certain level (which is referred to as a threshold voltage hereinafter and indicated by Vth in FIG. 9), whereas the emission current Ie is practically undetectable when the applied voltage is found lower than the threshold value Vth. Differently stated, an electron-emitting device according to the invention is a non-linear device having a clear threshold voltage Vth to the emission current Ie.

(ii) Secondly, since the emission current Ie is highly dependent on the device voltage Vf, the former can be effectively controlled by way of the latter.

(iii) Thirdly, the emitted electric charge captured by the anode 15 is a function of the duration of time of application of the device voltage Vf. In other words, the amount of electric charge captured by the anode 15 can be effectively controlled by way of the time during which the device voltage Vf is applied.

Because of the above remarkable features, it will be understood that the electron-emitting behavior of an electron source comprising a plurality of electron-emitting devices according to the invention, and hence that of an image-forming apparatus incorporating such an electron source, can easily be controlled in response to the input signal. Thus, such an electron source and an image-forming apparatus may find a variety of applications.

On the other hand, the device current If either monotonically increases relative to the device voltage Vf (as shown by a solid line in FIG. 9, a characteristic referred to as "MI characteristic" hereinafter) or changes to show a curve (not shown) specific to a voltage-controlled-negative-resistance characteristic (a characteristic referred to as "VCNR characteristic" hereinafter). These characteristics of the device current are dependent on a number of factors including the manufacturing method, the conditions where it is gauged and the environment for operating the device.

Now, an electron source and an image-forming apparatus to which the present invention is applicable will be described. An electron source and hence an image-forming apparatus can be realized by arranging a plurality of electron-emitting devices to which the present invention is applicable on a substrate.

Electron-emitting devices may be arranged on a substrate in a number of different modes.

For instance, a number of electron-emitting devices may be arranged in parallel rows along a direction (hereinafter referred to row-direction), each device being connected by wires as at opposite ends thereof, and driven to operate by control electrodes (hereinafter referred to as grids) arranged in a space above the electron-emitting devices along a direction perpendicular to the row direction (hereinafter referred to as column-direction) to realize a ladder-like arrangement. Alternatively, a plurality of electron-emitting devices may be arranged in rows along an X-direction and columns along an Y-direction to form a matrix, the X- and Y-directions being perpendicular to each other, and the electron-emitting devices on a same row are connected to a common X-directional wire by way of one of the electrodes of each device while the electron-emitting devices on a same column are connected to a common Y-directional wire by way of the other electrode of each device. The latter arrangement is referred to as a simple matrix arrangement. Now, the simple matrix arrangement will be described in detail.

In view of the above described three basic characteristic features (i) through (iii) of a surface conduction electron-emitting device, to which the invention is applicable, it can be controlled for electron emission by controlling the wave height and the wave width of the pulse voltage applied to the opposite electrodes of the device above the threshold voltage level. On the other hand, the device does not practically emit any electron below the threshold voltage level. Therefore, regardless of the number of electron-emitting devices arranged in an apparatus, desired surface conduction electron-emitting devices can be selected and controlled for electron emission in response to an input signal by applying a pulse voltage to each of the selected devices.

Figure 10:
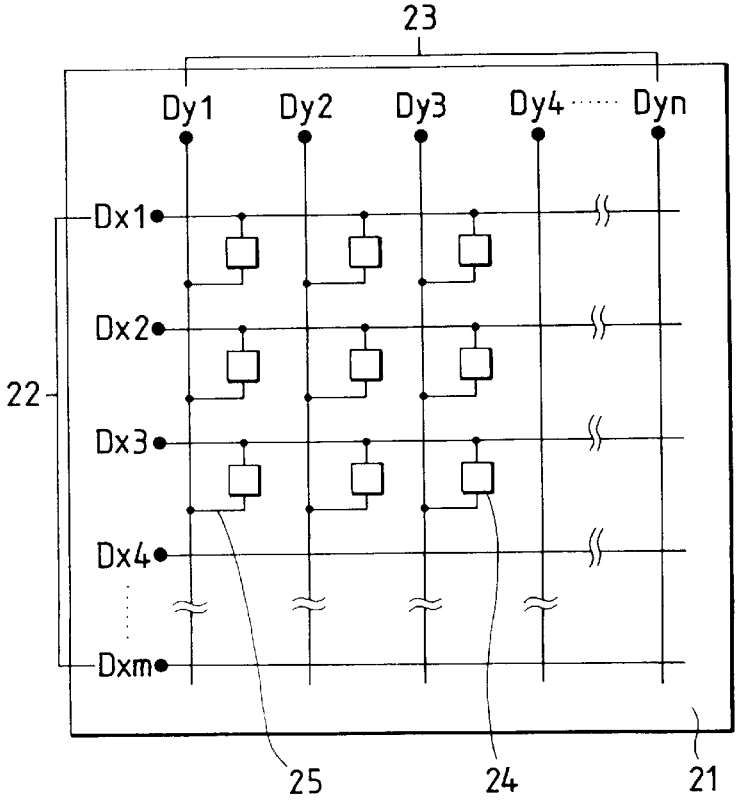
FIG. 10 is a schematic view of a first electron source realized by applying the present invention.

FIG. 10 is a schematic plan view of the substrate of an electron source realized by arranging a plurality of electron-emitting devices, to which the present invention is applicable, in order to exploit the above characteristic features. In FIG. 10, the electron source comprises an substrate 21, X-directional wires 22, Y-directional wires 23, electron-emitting devices 24 and connecting wires 25.

There are provided a total of m X-directional wires 22, which are denoted by Dx1, Dx2, . . . , Dxm and made of an electroconductive metal produced by vacuum deposition, printing or sputtering. These wires are so designed in terms of material, thickness and width that, if necessary, a substantially equal voltage may be applied to the surface conduction electron-emitting devices. A total of n Y-directional wires 23 are arranged and denoted by Dy1, Dy2, . . . , Dyn, which are similar to the X-directional wires 22 in terms of material, thickness and width. An interlayer insulation layer (not shown) is disposed between the m X-directional wires 22 and the n Y-directional wires 23 to electrically isolate them from each other (both m and n are integers).

The interlayer insulation layer (not shown) is typically made of $SiO_2$ and formed on the entire surface or part of the surface of the insulating substrate 1 to show a desired contour by means of vacuum evaporation, printing, sputtering, etc. For example, it may be formed on the entire surface or part of the surface of the substrate 21 on which the X-directional wires 22 are formed. The thickness, material and manufacturing method of the interlayer insulation layer are so selected as to make it withstand the potential difference between any of the X-directional wires 22 and any of the Y-directional wire 23 observable at the crossing thereof. Each of the X-directional wires 22 and the Y-directional wires 23 is drawn out to form an external terminal.

The oppositely arranged pair of electrodes (not shown) of each of the surface conduction electron-emitting devices 24 are connected to related one of the m X-directional wires 22 and related one of the n Y-directional wires 23 by respective connecting wires 25 which are made of an electroconductive metal.

The electroconductive metal material of the wires 22 and the wires 23, that of the connecting wires 25 and that of the device electrodes may be same or contain one or more than one common elements as so many ingredients. Alternatively, they may be different from each other. These materials may be appropriately selected typically from the candidate materials listed above for the device electrodes. If the device electrodes and the wires are made of a same material, the wires directly connected to the device electrodes may be collectively called device electrodes without discriminating the wires and the device electrodes.

The X-directional wires 22 are electrically connected to a scan signal application means (not shown) for applying a scan signal to a selected row of surface conduction electron-emitting devices 24. On the other hand, the Y-directional wires 23 are electrically connected to a modulation signal generation means (not shown) for applying a modulation signal to a selected column of surface conduction electron-emitting devices 24 and modulating the selected column according to an input signal. Note that the drive signal to be applied to each surface conduction electron-emitting device is expressed as the voltage difference of the scan signal and the modulation signal applied to the device.

In an electron source having a simple matrix wiring arrangement as described above, each of the electron-emitting devices can be selected and driven to operate independently.

Figure 11:
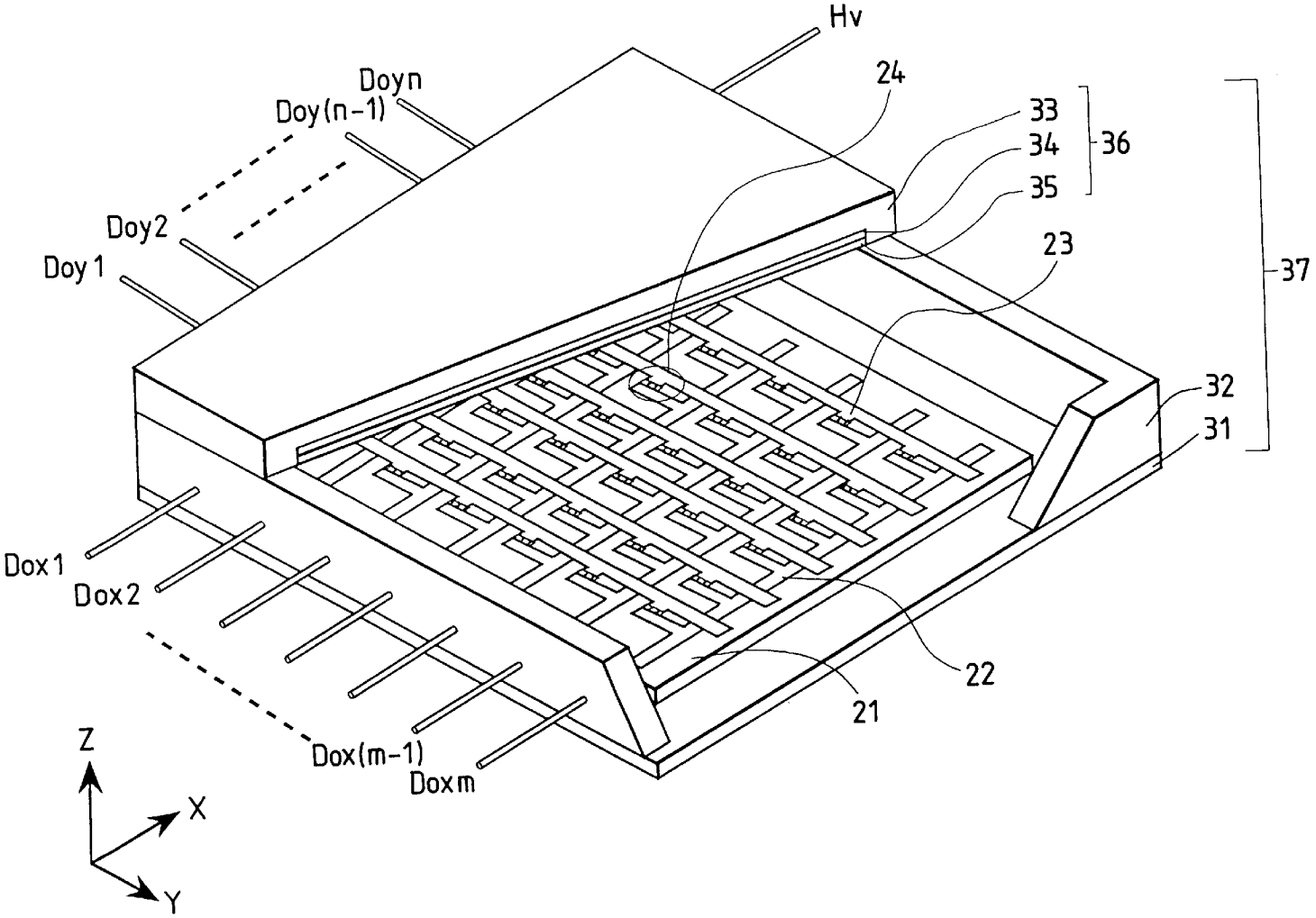
FIG. 11 is a partly cut away schematic perspective view of an image-forming apparatus comprising the electron source of FIG. 10.
Figure 12A:
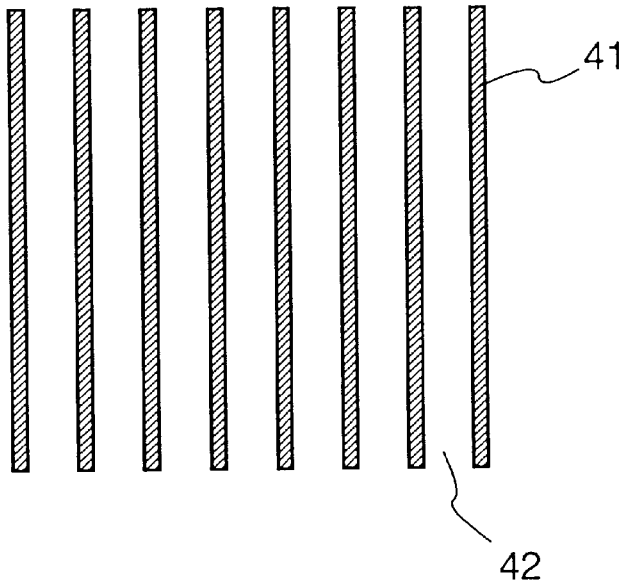
FIGS. 12A and 12B are two possible designs of fluorescent film that can be used for an image-forming apparatus realized by applying the present invention.
Figure 12B:
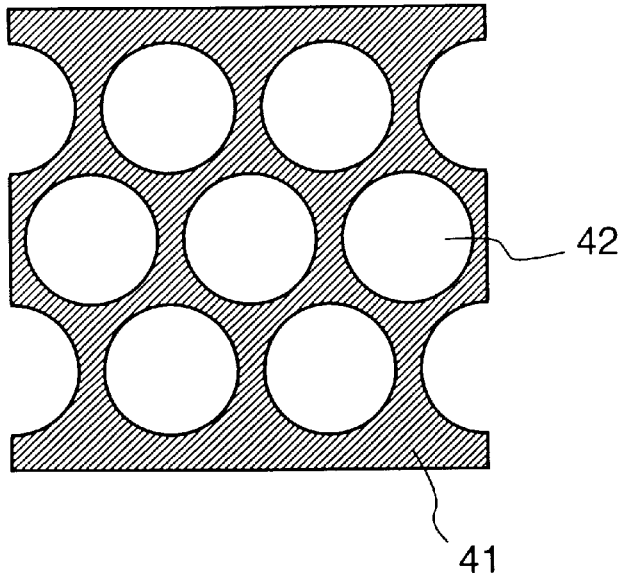
Figure 14:
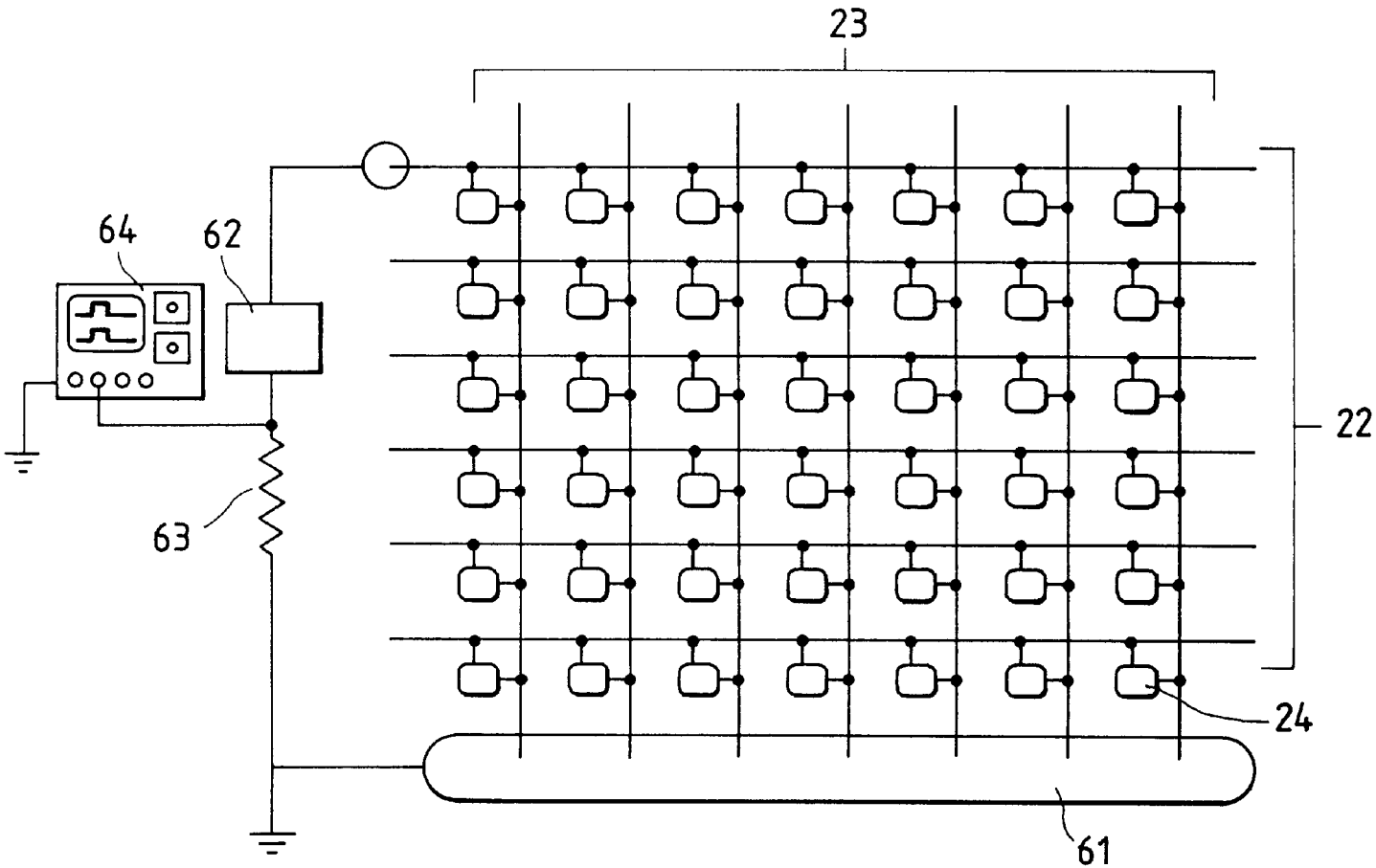
FIG. 14 is a circuit diagram for connecting the electron source of FIG. 10 to a power supply for carrying out an energization forming process.

Now, an image-forming apparatus comprising an electron source having a simple matrix arrangement as described above will be described by referring to FIGS. 11, 12A, 12B and 14. FIG. 11 is a partially cut away schematic perspective view of the image forming apparatus and FIGS. 12A and 12B show two possible configurations of a fluorescent film that can be used for the image forming apparatus of FIG. 11, whereas FIG. 14 is a block diagram of a drive circuit for the image forming apparatus of FIG. 11 that operates for NTSC television signals.

Referring firstly to FIG. 11 illustrating the basic configuration of the display panel of the image-forming apparatus, it comprises an electron source substrate 21 of the above described type carrying thereon a plurality of electron-emitting devices, a rear plate 31 rigidly holding the electron source substrate 21, a face plate 36 prepared by laying a fluorescent film 34 and a metal back 35 on the inner surface of a glass substrate 33 and a support frame 32, to which the rear plate 31 and the face plate 36 are bonded by means of frit glass having a low melting point.

Reference numeral 24 denotes a section that corresponds to the electron-emitting region of the device of FIGS. 1A and 1B. Reference numerals 22 and 23 respectively denotes X- and Y-directional wires, each being connected to the paired device electrodes 2 and 3 of the related electron-emitting devices 24.

While an envelope 37 is formed of the face plate 36, the support frame 32 and the rear plate 31 in the above described embodiment, the rear plate 31 may be omitted if the substrate 21 is strong enough by itself because the rear plate 31 is provided mainly for reinforcing the substrate 21. If such is the case, an independent rear plate 31 may not be required and the substrate 21 may be directly bonded to the support frame 32 so that the envelope 37 is constituted of a face plate 36, a support frame 32 and a substrate 21. The overall strength of the envelope 37 against the atmospheric pressure may be increased by arranging a number of support members called spacers (not shown) between the face plate 36 and the rear plate 31.

FIGS. 12A and 12B schematically illustrate two possible arrangements of fluorescent film that can be used for the purpose of the invention. While the fluorescent film 34 may comprise only a single fluorescent body if the display panel is used for showing black and white pictures, it needs to comprise black conductive members 41 and fluorescent bodies 42 for displaying color pictures, of which the former are referred to as black stripes or members of a black matrix depending on the arrangement of the fluorescent bodies. Black stripes or members of a black matrix are arranged for a color display panel so that the fluorescent bodies 42 of three different primary colors are made less discriminable and the adverse effect of reducing the contrast of displayed images of external light reflected by the fluorescent film 34 is weakened by blackening the surrounding areas. While graphite is normally used as a principal ingredient of the black stripes, other conductive material having low light transmissivity and reflectivity may alternatively be used.

A precipitation or printing technique is suitably used for applying a fluorescent material on the glass substrate 33 regardless of black and white or color display. An ordinary metal back 35 is arranged on the inner surface of the fluorescent film 34. The metal back 35 is provided in order to enhance the luminance of the display panel by causing the rays of light emitted from the fluorescent bodies and directed to the inside of the envelope to turn back toward the face plate 36, to use it as an electrode for applying an accelerating voltage to electron beams and to protect the fluorescent bodies against damages that may be caused when negative ions generated inside the envelope collide with them. It is prepared by smoothing the inner surface of the fluorescent film (in an operation normally called "filming") and forming an Al film thereon by vacuum deposition after forming the fluorescent film.

A transparent electrode (not shown) may be formed on the face plate 36 facing the outer surface of the fluorescent film 34 in order to raise the conductivity of the fluorescent film 34.

Care should be taken to accurately align each set of color fluorescent bodies and an electron-emitting device, if a color display is involved, before the above listed components of the envelope are bonded together.

An image-forming apparatus shown in FIG. 11 can be manufactured typically in a manner as described below.

Figure 13:
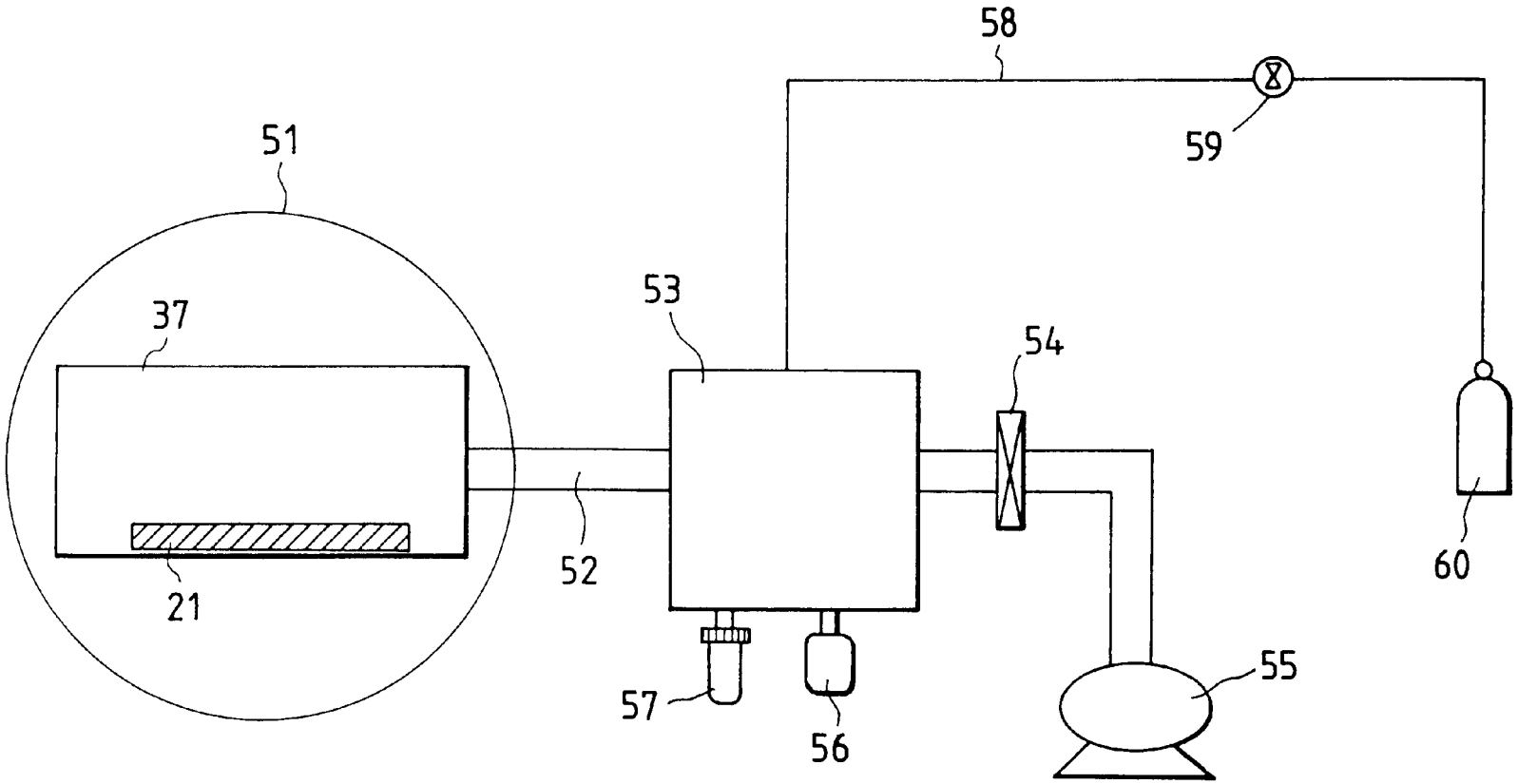
FIG. 13 is a schematic block diagram of a vacuum apparatus for manufacturing an image-forming apparatus by applying the present invention.

FIG. 13 is a block diagram of an apparatus designed to manufacture an image-forming apparatus. An image-forming apparatus 51 is connected to a vacuum chamber 53 by way of an exhaust pipe 52 and further to an exhaustion apparatus 55 by way of a gate valve 54. The vacuum chamber 53 contains therein a pressure gauge 56, a quadrupole mass spectrometer 57 and other instruments for detecting the internal pressure and the partial pressures of the components of the atmosphere in the vacuum chamber. Since it is difficult to directly detect the internal pressure of the envelope 37 of the image-forming apparatus 51, the processing conditions of the apparatus are controlled by observing the pressure in the vacuum chamber 53 and other measurable variables.

The vacuum chamber 53 is further connected with a gas feed line 58 for introducing gas into the vacuum chamber that is necessary to control the internal conditions of the chamber. The opposite end of the gas feed line 58 is connected to a supply source 60 of the substance to be introduced into the vacuum chamber. A gas introducing rate control means 59 is arranged on the gas introducing line for controlling the rate of supply of the substance. The gas introducing rate control means may be a slow leak valve or a mass flow controller that can control the rate of releasing gas depending on the type of the gas to be used.

The inside of the envelope 37 is evacuated by means of the arrangement of FIG. 13 and the electron-emitting devices of the image-forming apparatus are subjected to energization forming. To carry out this process, the Y-directional wires 23 are connected to a common electrode 61 and a pulse voltage is applied to all the electron-emitting devices connected to one of the X-directional wires 22 from a power source 62. The pulse waveform and the timing of terminating the energization forming process may be appropriately determined depending on the specific conditions and requirements for treating the electron-emitting devices as described earlier on the operation of energization forming for a single electron-emitting device. A pulse voltage may be sequentially applied to a plurality of X-directional wires, shifting the phase of the pulse (scrolling), in order to carry out the energization forming operation collectively on the devices connected to the plurality of X-directional wires. In FIG. 14, reference numerals 63 ad 64 respectively denotes a resistor and an oscilloscope for detecting the intensity of electric current.

After completing the energization forming process, the apparatus is subjected to an activation process. In this process, after sufficiently evacuating the envelope 37, gas containing organic substances is introduced into it through the gas feed line 58. Alternatively, the envelope 37 may be evacuated by means of an oil diffusion pump or a rotary pump and the residual organic substances remaining in the vacuum may be utilized as described earlier for a single electron-emitting device. If necessary, inorganic substances may also be introduced into the envelope. As a voltage is applied to the individual electron-emitting devices in such an atmosphere containing organic substances, carbon or a carbon compound, or a mixture of both, is deposited on the electron-emitting region of each electron-emitting device to dramatically increase the rate of electron-emitting as described earlier with regard to a single electron-emitting device. The wiring arrangement for energization forming may also be used for the activation process so that the voltage is applied to all the electron-emitting devices connected to a common directional wire.

After the activation process, the electron-emitting devices are preferably subjected to a stabilization process as in the case of a single electron-emitting device.

The envelope 37 is evacuated by way of the exhaust pipe 52, using an oil free exhaust system 55 typically comprising an ion pump and a sorption pump, while heating the inside to 80 to 250° C. and maintaining the temperature level, until the atmosphere in the inside is reduced to a sufficient degree of vacuum containing organic substances to a very low concentration, when it is hermetically sealed by heating and melting the exhaust pipe. A getter process may be conducted in order to maintain the achieved degree of vacuum in the inside of the envelope 37 after it is sealed. In a getter process, a getter arranged at a predetermined position (not shown) in the envelope 37 is heated by means of a resistance heater or a high frequency heater to form a film by vapor deposition immediately before or after the envelope 38 is sealed. A getter typically contains Ba as a principal ingredient and can maintain the degree of vacuum established in the envelope 37 by the adsorption effect of the vapor deposition film.

Figure 15:
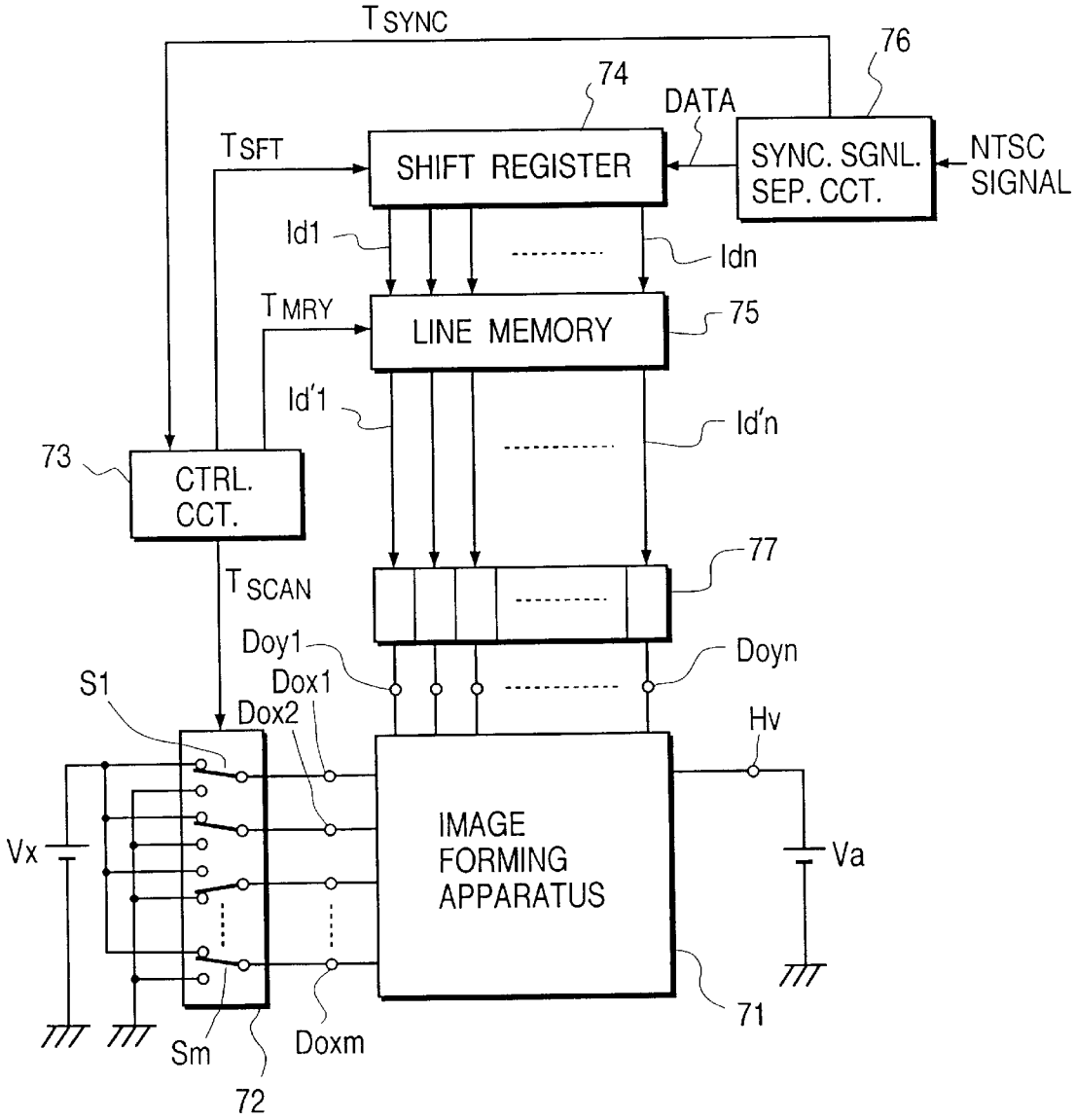
FIG. 15 is a circuit diagram of a drive circuit that can be used to drive an image-forming apparatus manufactured by the method of the present invention and adapted to NTSC signals.

Now, a drive circuit for driving a display panel comprising an electron source with a simple matrix arrangement for displaying television images according to NTSC television signals will be described by referring to FIG. 15. In FIG. 15, reference numeral 71 denotes an image-forming apparatus. Otherwise, the circuit comprises a scan circuit 72, a control circuit 73, a shift register 74, a line memory 75, a synchronizing signal separation circuit 76 and a modulation signal generator 77. Vx and Va in FIG. 15 denote DC voltage sources.

The image-forming apparatus 71 is connected to external circuits via terminals Dox1 through Doxm, Doy1 through Doyn and high voltage terminal Hv, of which terminals Dox1 through Doxm are designed to receive scan signals for sequentially driving on a one-by-one basis the rows (of N electron-emitting devices) of an electron source in the apparatus comprising a number of surface-conduction type electron-emitting devices arranged in the form of a matrix having M rows and N columns.

On the other hand, terminals Doy1 through Doyn are designed to receive a modulation signal for controlling the output electron beam of each of the surface-conduction type electron-emitting devices of a row selected by a scan signal. High voltage terminal Hv is fed by the DC voltage source Va with a DC voltage of a level typically around 10 kV, which is sufficiently high to energize the fluorescent bodies of the selected surface-conduction type electron-emitting devices.

The scan circuit 72 operates in a manner as follows. The circuit comprises M switching devices (of which only devices Sl and Sm are specifically indicated in FIG. 13), each of which takes either the output voltage of the DC voltage source Vx or 0V (the ground potential level) and comes to be connected with one of the terminals Dox1 through Doxm of the display panel 71. Each of the switching devices Sl through Sm operates in accordance with control signal Tscan fed from the control circuit 73 and can be prepared by combining transistors such as FETs.

The DC voltage source Vx is so arranged that it produces a constant voltage that keeps the drive voltage being applied to the devices that are not currently scanned under a threshold voltage level as defined by the performance of the electron-emitting devices (electron-emitting device threshold voltage).

The control circuit 73 coordinates the operations of related components so that images may be appropriately displayed in accordance with externally fed video signals. It generates control signals Tscan, Tsft and Tmry in response to synchronizing signal Tsync fed from the synchronizing signal separation circuit 76, which will be described below.

The synchronizing signal separation circuit 76 separates the synchronizing signal component and the luminance signal component form an externally fed NTSC television signal and can be easily realized using a popularly known frequency separation (filter) circuit. Although a synchronizing signal extracted from a television signal by the synchronizing signal separation circuit 76 is constituted, as well known, of a vertical synchronizing signal and a horizontal synchronizing signal, it is simply designated as Tsync signal here for convenience sake, disregarding its component signals. On the other hand, a luminance signal drawn from a television signal, which is fed to the shift register 74, is designed as DATA signal.

The shift register 74 carries out for each line a serial/parallel conversion on DATA signals that are serially fed on a time series basis in accordance with control signal Tsft fed from the control circuit 73. (In other words, a control signal Tsft operates as a shift clock for the shift register 74.) A set of data for a line that have undergone a serial/parallel conversion (and correspond to a set of drive data for n electron-emitting devices) are sent out of the shift register 74 as n parallel signals Id1 through Idn.

The line memory 75 is a memory for storing a set of data for a line, which are signals Id1 through Idn, for a required period of time according to control signal Tmry coming from the control circuit 73. The stored data are sent out as I'd1 through I'dn and fed to modulation signal generator 77.

Said modulation signal generator 77 is in fact a signal source that appropriately drives and modulates the operation of each of the surface-conduction type electron-emitting devices according to the image data I'd1 through I'dn and output signals of this device are fed to the surface-conduction type electron-emitting devices in the display panel 71 via terminals Doy1 through Doyn.

As described above, an electron-emitting device, to which the present invention is applicable, is characterized by the following features in terms of emission current Ie. Firstly, there exists a clear threshold voltage Vth and the device emit electrons only a voltage exceeding Vth is applied thereto. Secondly, the level of emission current Ie changes as a function of the change in the applied voltage above the threshold level Vth, although the value of Vth and the relationship between the applied voltage and the emission current may vary depending on the materials, the configuration and the manufacturing method of the electron-emitting device. More specifically, when a pulse-shaped voltage is applied to an electron-emitting device according to the invention, practically no emission current is generated so far as the applied voltage remains under the threshold level, whereas an electron beam is emitted once the applied voltage rises above the threshold level. It should be noted here that the intensity of an output electron beam can be controlled by changing the peak level Vm of the pulse-shaped voltage. Additionally, the total amount of electric charge of an electron beam can be controlled by varying the pulse width Pw.

Thus, either modulation method or pulse width modulation may be used for modulating an electron-emitting device in response to an input signal. With voltage modulation, a voltage modulation type circuit is used for the modulation signal generator 77 so that the peak level of the pulse shaped voltage is modulated according to input data, while the pulse width is held constant.

With pulse width modulation, on the other hand, a pulse width modulation type circuit is used for the modulation signal generator 77 so that the pulse width of the applied voltage may be modulated ad according to input data, while the peak level of the applied voltage is held constant.

Although it is not particularly mentioned above, the shift register 74 and the line memory 75 may be either of digital or of analog signal type so long as serial/parallel conversions and storage of video signals are conducted at a given rate.

If digital signal type devices are used, output signal DATA of the synchronizing signal separation circuit 76 needs to be digitized. However, such conversion can be easily carried out by arranging an A/D converter at the output of the synchronizing signal separation circuit 76. It may be needless to say that different circuits may be used for the modulation signal generator 77 depending on whether output signals of the line memory 75 are digital signals or analog signals. If digital signals are used, a D/A converter circuit of a known type may be used for the modulation signal generator 77 and an amplifier circuit may additionally be used, if necessary. As for pulse width modulation, the modulation signal generator 77 can be realized by using a circuit that combines a high speed oscillator, a counter for counting the number of waves generated by said oscillator and a comparator for comparing the output of the counter and that of the memory. If necessary, an amplifier may be added to amplify the voltage of the output signal of the comparator having a modulated pulse width to the level of the drive voltage of a surface-conduction type electron-emitting device according to the invention.

If, on the other hand, analog signals are used with voltage modulation, an amplifier circuit comprising a known operational amplifier may suitably be used for the modulation signal generator 77 and a level shift circuit may be added thereto if necessary. As for pulse width modulation, a known voltage control type oscillation circuit (VCO) may be used with, if necessary, an additional amplifier for voltage amplification up to the drive voltage of surface-conduction type electron-emitting device.

With an image forming apparatus comprising a display panel 71 and a drive circuit having a configuration as described above, to which the present invention is applicable, the electron-emitting devices emit electrons as a voltage is applied thereto by way of the external terminals Dox1 through Doxm and Doy1 through Doyn. Then, the generated electron beams are accelerated by applying a high voltage to the metal back 115 or a transparent electrode (not shown) by way of the high voltage terminal Hv. The accelerated electrons eventually collide with the fluorescent film 114, which in turn emits light to produce images.

The above described configuration of an image forming apparatus is only an example to which the present invention is applicable and may be subjected to various modifications. The TV signal system to be used with such an apparatus is not limited to a particular one, and any system such as NTSC, PAL or SECAM may feasibly be used with it. It is particularly suited for TV signals involving a larger number of scanning lines (typically of a high definition TV system such as the MUSE system) because it can be used for a large display panel comprising a large number of pixels.

Now, an electron source comprising a plurality of surface conduction electron-emitting devices arranged in a ladder-like manner on a substrate and an image-forming apparatus comprising such an electron source will be described by referring to FIGS. 16 and 17.

Figure 16:
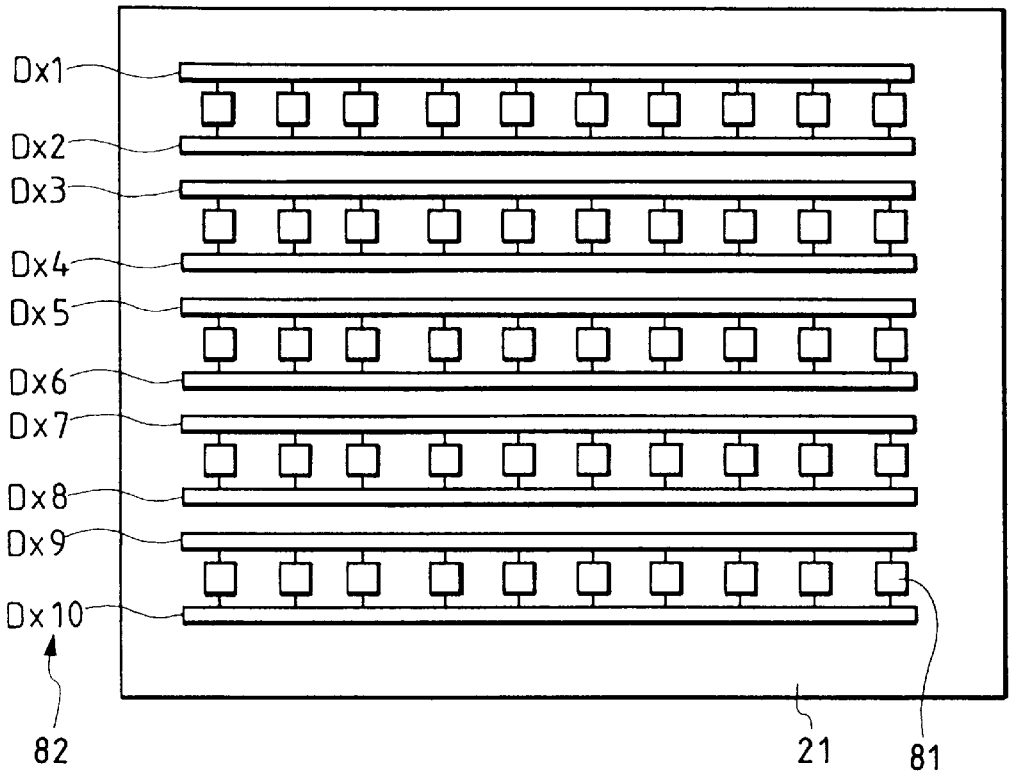
FIG. 16 is a schematic view of a second electron source realized by applying the present invention.
Figure 18:
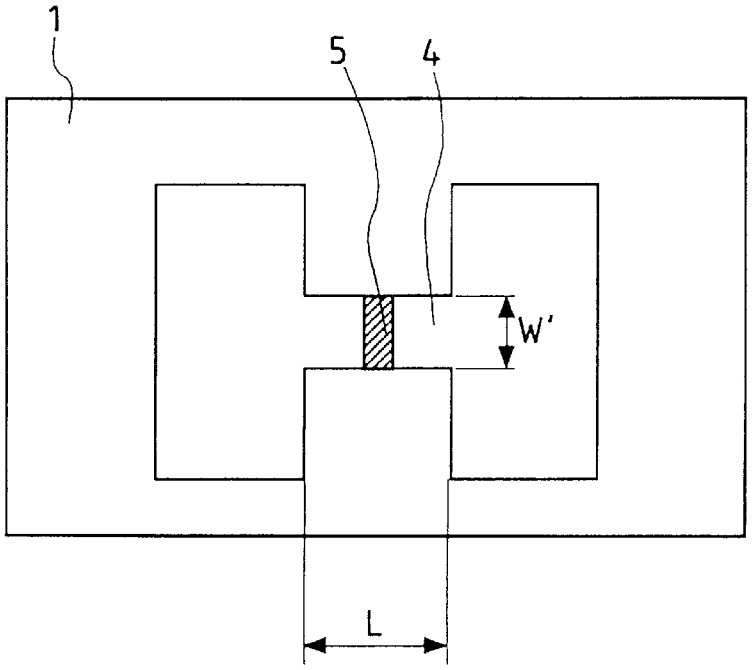
FIG. 18 is a schematic view of a known electron-emitting device.

Firstly referring to FIG. 16 schematically showing an electron source having a ladder-like arrangement, reference numeral 21 denotes an electron source substrate and reference numeral 81 denotes an electron-emitting device arranged on the substrate, whereas reference numeral 82 and Dx1 through Dx10 denote common wires for connecting the electron-emitting devices. The electron-emitting devices 82 are arranged in rows (to be referred to as device rows hereinafter) on the substrate 21 to form an electron source comprising a plurality of device rows, each row having a plurality of devices. The surface conduction electron-emitting devices of each device row are electrically connected in parallel with each other by a pair of common wires so that they can be driven independently by applying an appropriate drive voltage to the pair of common wires. More specifically, a voltage exceeding the electron emission threshold level is applied to the device rows to be driven to emit electrons, whereas a voltage below the electron emission threshold level is applied to the remaining device rows. Alternatively, any two common wires arranged bd between two adjacent device rows can share a single common wire. Thus, for example, the wires Dx2 and Dx3 of the common wires Dx2 through Dx9 may be replaced by a single wire.

Figure 17:
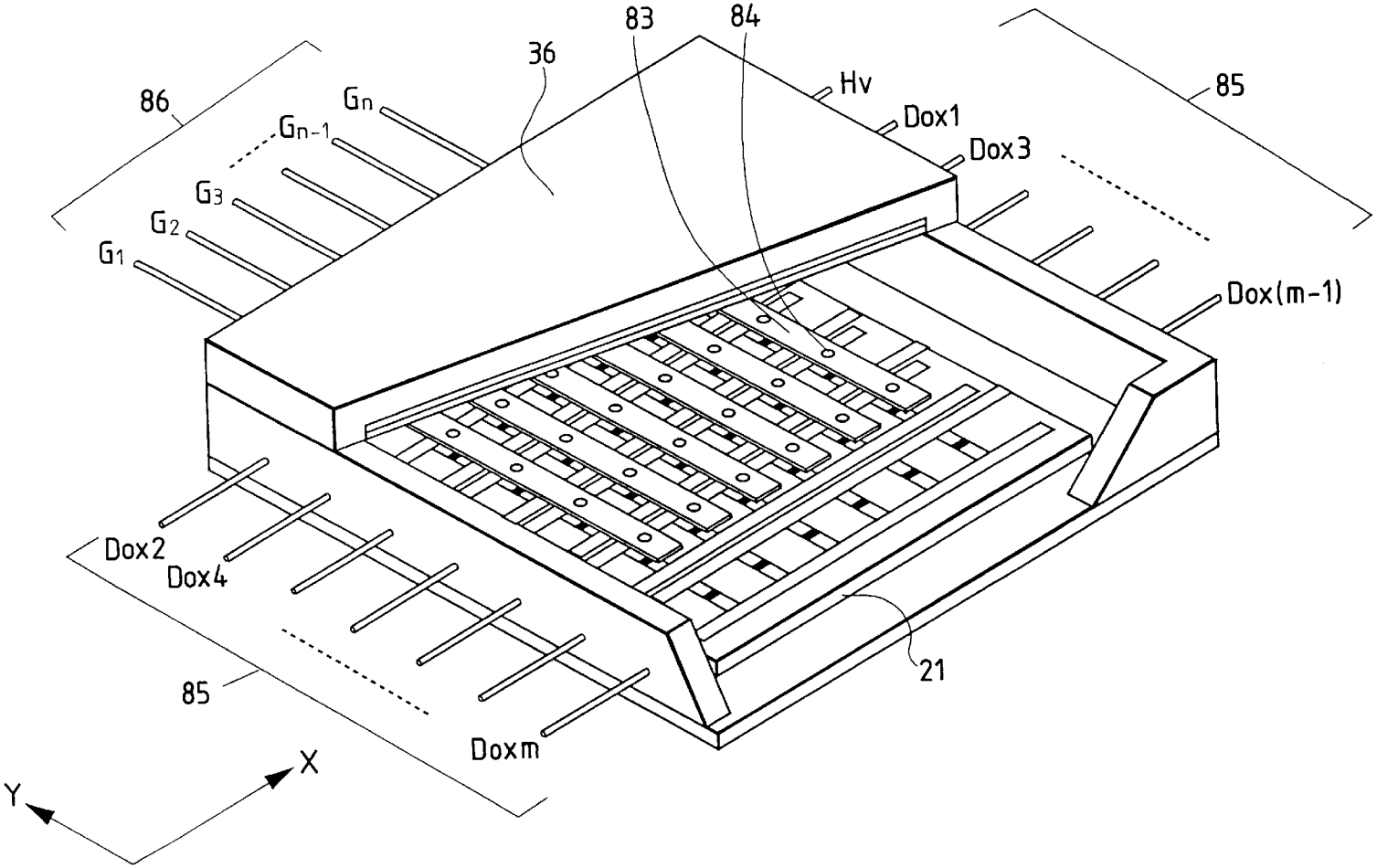
FIG. 17 is a partly cut away schematic perspective view of an image-forming apparatus comprising the electron source of FIG. 16.
Figure 19A:
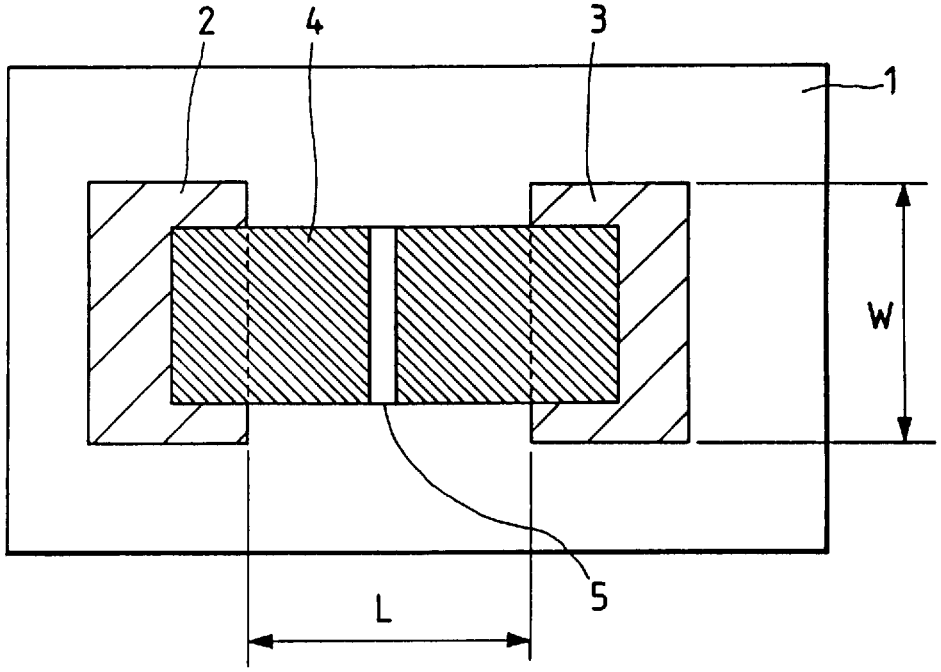
FIGS. 19A and 19B are schematic views of another known electron-emitting device.
Figure 19B:
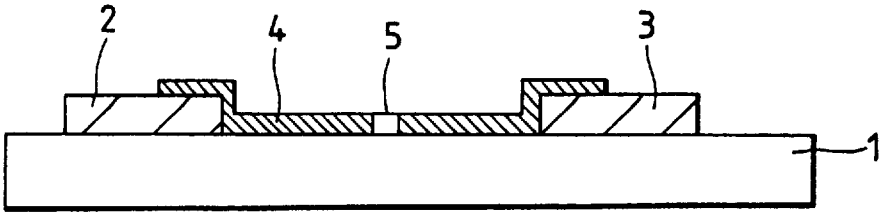

FIG. 17 is a schematic perspective view of the display panel of an image-forming apparatus incorporating an electron source having a ladder-like arrangement of electron-emitting devices. In FIG. 17, the display panel comprises grid electrodes 83, each provided with a number of bores 84 for allowing electrons to pass therethrough and a set of external terminals 85, or Dox1, Dox2, . . . , Doxm, along with another set of external terminals 86, or G1, G2, . . . , Gn, connected to the respective grid electrodes 86. The display panel of FIG. 17 differs from the display panel comprising an electron source with a simple matrix arrangement of FIG. 16 mainly in that the apparatus of FIG. 17 has grid electrodes 83 arranged between the substrate 21 and the face plate 36.

In FIG. 17, the stripe-shaped grid electrodes 36 are arranged between the substrate 21 and the face plate 36 perpendicularly relative to the ladder-like device rows for modulating electron beams emitted from the surface conduction electron-emitting devices, each provided with through bores 84 in correspondence to respective electron-emitting devices for allowing electron beams to pass therethrough. Note that, however, while stripe-shaped grid electrodes are shown in FIG. 17, the profile and the locations of the electrodes are not limited thereto. For example, the grid electrodes may alternatively be provided with mesh-like openings and arranged around or close to the surface conduction electron-emitting devices.

The external terminals 85 and the external terminals 86 for the grids are electrically connected to a control circuit (not shown).

An image-forming apparatus having a configuration as described above can be operated for electron beam irradiation by simultaneously applying modulation signals to the rows of grid electrodes for a single line of an image in synchronism with the operation of driving (scanning) the electron-emitting devices on a row by row basis so that the image can be displayed on a line by line basis.

Thus, a display apparatus according to the invention and having a configuration as described above can have a wide variety of industrial and commercial applications because it can operate as a display apparatus for television broadcasting, as a terminal apparatus for video teleconferencing, as an editing apparatus for still and movie pictures, as a terminal apparatus for a computer system, as an optical printer comprising a photosensitive drum and in many other ways.

EXAMPLES

Now, the present invention will be described by way of examples.

Example 1

Each of the electron-emitting devices prepared in this example had a configuration as schematically illustrated in FIGS. 1A and 1B. The steps used for preparing the electron-emitting device will be described below.

The following electroconductive film producing inks were used for this example.

Ink A: An aqueous solution of palladium acetate monoethanolamine (PAME) with a metal concentration of 2 wt %.

Ink B: An ink obtained by diluting Ink A with water to a volume three times as much as the volume of the original ink.

Before preparing an electron source, the ink discharging performance of the ink-jet apparatus to be used in this example was regulated in the following manner.

Firstly, two ink-jet apparatus comprising piezoelectric devices were charged respectively with the above inks.

The inks were injected onto a piece of quartz same as the one used for the electron source substrate in this example in order to produce film dots, which were then heat-treated at 300° C. in the atmosphere for 10 minutes. Then, the thickness and the diameter of each film dot were observed and the ink-jet apparatus were regulated until the film dots of Inks A and B showed respective thicknesses of 30 nm and 10 nm and a same diameter of about 20 $\mu$m.

Step 1

After fully washing a quartz substrate and drying it, a plurality of device electrode pairs and a matrix of wires connecting them were formed on the substrate by means of the techniques of vacuum film forming and photolithography. The device electrodes were made of Ni and were 100 nm thick. The device electrodes of each pair were separated by a distance L of 20 $\mu$m and had a length W of 100 $\mu$m.

Step 2

A dot of Ink A was formed on each device electrode pair for the electroconductive film 4-1 of FIG. 1A by means of the related ink-jet apparatus. The ink-jet apparatus was so regulated that the center of the dot was displaced from the edge of the device electrode 2 by 5 $\mu$m toward the device electrode 3. In this way, a dot was formed in position on each and every device electrode pair on the quartz substrate.

Step 3

A dot of Ink B was formed in a similar manner. The center of the dot was displaced from the edge of the device electrode 3 by 5 $\mu$m toward the device electrode 2 so that the centers of the two dots were separated from each other by 10 $\mu$m.

Step 4

Then, the dots were heated at 300° C. in the atmosphere for 10 minutes to produce an electroconductive film 4 comprising fine particles of PdO between each device electrode pair.

Step 5

The electroconductive film was then subjected to an energization forming process to produce an electron-emitting region. A triangular pulse voltage having a gradually increasing wave height as shown in FIG. 7B was used for energization forming. All the column-directional wires were connected to the ground and the pulse voltage was applied to the row-directional wires on a one-by-one basis until an electron-emitting region is produced on each and every electron-emitting device of the electron source.

When the electron source was observed through a scanning electronic microscope (SEM), it was found that an electron-emitting region had been produced in the film dot having a smaller thickness at a position along the related edge of the corresponding device electrode in each electron-emitting device.

Step 6

The electron source comprising a number of electron-emitting regions was combined with a face plate, a rear plate, a support frame and other members to produce an image-forming apparatus as illustrated in FIG. 11. Subsequently, the electron-emitting devices were subjected to an activation process. After evacuating the inside of the envelope of the image-forming apparatus by means of an vacuum/exhaust apparatus and by way of an exhaust pipe (not shown), acetone was introduced into the envelope and the internal pressure was regulated to $1.3\times10^{-1}$ Pa. Then, a rectangular pulse voltage having a wave height of 16V and a pulse width of 100 $\mu$sec. was applied to all the row-directional wires by means of a drive circuit via respective external terminals. The drive circuit was so arranged that the pulse was applied to the row-directional wires cyclically with a slightly shifting timing to show a cycle of 60 Hz for the entire electron source. The pulse voltage was applied for 30 minutes and thereafter the inside of the envelope was evacuated for another time.

Step 7

The entire envelope was evacuated at 200° C. until the internal pressure fell to $2.7\times10^{-5}$ Pa after 10 hours. Then, the envelope was cooled gradually, while continuing the evacuation, and finally the exhaust pipe was heated, molten and sealed by a means of a bar. Thereafter, the getter (not shown) arranged in the envelope in advance was heated by high frequency heating for a gettering process.

The prepared image-forming apparatus was then driven for simple matrix operation of the electron-emitting devices of the electron source by applying a voltage of 5 kV to the metal back by way of the high voltage terminal and the emission current of each electron-emitting device was observed. The Ie of the electron-emitting devices showed a dispersion of 12%.

Comparative Example 1

In this example, an electron source was prepared by following the steps of Example 1 except the dots were produced simply by means of Ink A in Step 3 and the electron-emitting region of each electron-emitting device was observed through an SEM. It was found that the electron-emitting region was meandering within a range equal to about a half of the distance separating the device electrodes. An image-forming apparatus was prepared by using the electron source and tested for the performance of electron emission. The Ie of the electron-emitting devices showed a dispersion of 16%.

Example 2

Each of the electron-emitting devices prepared in this example basically had the configuration as schematically illustrated in FIGS. 3A and 3B, although the device electrodes were separated by a distance of 140 μm and five dots having a diameter of 50 μm were arranged on each row running along a line connecting the device electrodes while three dots were arranged on each column running along a line perpendicular to the above line. Of the dots, the three dots of the center column were formed by Ink B, whereas all the remaining dots were formed by Ink A. The center of each of the dots of Ink A along the extreme columns running along the corresponding edges of the respective device electrodes was displaced from the corresponding edge by 10 μm and that of each of the dots of Ink A arranged inside was separated from the corresponding edge by 25 μm. The dots of Ink B were arranged along the center line of the gap separating the device electrodes. The centers of any adjacent dots of each column perpendicular to the line connecting the device electrodes were separated by 25 μm from each other.

The electron-emitting region of each electron-emitting device was observed through an SEM to see the result of the energization forming process. It was found that the electron-emitting region was meandering only within the width of 20 μm along the center line of the gap separating the device electrodes, or within the dots formed by Ink B.

An image-forming apparatus was prepared by using the electron source as in Example 1 and operated to see its electron-emitting performance. The Ie of the electron-emitting devices showed a dispersion of 12%.

Comparative Example 2

In this example, an electron source was prepared by following the steps of Example 2 except all the dots were produced simply by means of Ink A and the electron-emitting region of each electron-emitting device was observed through an SEM. It was found that the electron-emitting region was meandering within a range equal to about a half of the distance separating the device electrodes. An image-forming apparatus was prepared by using the electron source and tested for the performance of electron emission. The Ie of the electron-emitting devices showed a dispersion of 18%.

The size of the bright spots of the image-forming apparatus of Example 2 and that of Comparative Example 2 were observed. While the bright spots of Example 2 were about 150 μm large, those of Comparative Example 2 were about 200 μm. The difference of 50 μm may reflect the extent of meandering of the electron-emitting regions.

Example 3

The electron-emitting devices prepared in this example had the configuration substantially the same as that of the devices of Example 1. The steps of Example 1 were followed except that all the film dots were produced by using Ink B and each of the film dots having a greater thickness was produced by applying three drops of Ink B three times, whereas each of the film dots having a smaller thickness were produced by applying a single drop of Ink B.

When observed through an SEM and driven to operate for electron emission, it was found that the electron-emitting devices were substantially same as their counterparts of Example 1.

Examples 4 and 5

The steps of Examples 1 and 2 were followed except that head bodies (with no ink) of Bubble Jet Printer Heads (Trade Name: BC-01, available from Canon Inc.) were used for the ink-jet apparatus. The produced electron-emitting regions were similar to those of Examples 1 and 2 in terms of profile and electron-emitting performance.

Example 6

As in the case of Example 1, paired device electrodes and wires were arranged on a quartz substrate. Then, a single dot of Ink A was formed on each pair of device electrodes. The device electrodes of each pair were separated by a gap of 20 μm and the ink-jet apparatus was so regulated to produce a dot having a diameter of 40 μm on each pair of device electrodes.

Since it had been found that the electron-emitting region of an electron-emitting device can be formed along an edge of one of the paired device electrodes with certainty if the dot of electroconductive film has widths at the corresponding edges of the device electrodes that satisfy the relationship of $(w_1/w_2) \geqq 2$, the dot was formed in such a way that the center of the dot was displaced from the center line of the gap between the device electrodes by 7.5 μm toward the device electrode 2. Geometrically, $(w_1/w_2) \approx 2.05$ under this condition so that the above requirement was satisfied. If the dot was displaced less, the positional controllability of the electron-emitting region was reduced. On the other hand, if the dot was displaced further, the value of $w_2$ decreased rapidly to consequently reduce the length of the electron-emitting region and hence the rate of emission of electrons. Therefore, the dot should not be displaced disproportionally. When observed through an SEM, as in the case of Example 1, all the electron-emitting devices showed an electron-emitting region formed along the corresponding edge of the device electrode 3 in an intended manner. When tested for electron emission, the Ie of the electron-emitting devices showed a dispersion of 10%.

Comparative Example 3

In this example, an image-forming apparatus was prepared as in the case of Example 6 except the center of each dot was placed on the center line of the gap separating the device electrodes. It was found that the electron-emitting region was meandering greatly in the gap between the device electrodes. The Ie of the electron-emitting devices showed a dispersion of 14%.

Example 7

This example resembled to Example 6 but the gap separating each pair of device electrodes was 30 μm and five dots were having a diameter of 60 μm were produced on each pair of device electrodes. The center of each dot was displaced by 11 μm from the center line of the gap separating the device electrodes. The five dots were arranged along a line perpendicular to a line connecting the pair of device electrodes and any adjacent dots were separated by 30 μm. While the electroconductive thin film formed by the dots covered the related edges of the device electrodes to a substantially same extent as a whole, it showed different film thickness along the edges because the dots were overlapping to a greater extent along the edge of the device electrode 2.

When observed through an SEM after an energization forming process as in the case of Example 6, all the electron-emitting devices showed an electron-emitting region formed along the corresponding edge of the device electrode 3 in an intended manner. An image-forming apparatus was prepared by using the electron-emitting devices and tested for electron emission to see that the Ie of the electron-emitting devices showed a dispersion of 8%.

Example 8

Each of the electron-emitting devices prepared in this example had a configuration as schematically illustrated in FIGS. 5A and 5B. The following electroconductive film producing inks were used for this example.

Ink C: An aqueous solution of tetrammineplatinum (II) nitrate with a metal concentration of 2 wt %.

Ink D: Same as Ink A (PAME)

Step 1

After fully washing a quartz substrate and drying it, a plurality of device electrode pairs 2 and 3 of Pt were formed by offset printing. The ink used here was Pt resinate paste. After forming the device electrodes to a desired profile, they were dried at 70° C. and baked at 580° C. in the atmosphere to produce the device electrodes having a thickness of about 100 nm, the device electrodes of each pair being separated by a gap of 30 μm. Each electron-emitting device was independently formed and not provided with matrix wiring.

Step 2

The two inks were loaded into the respective printer head bodies (with no ink) of bubble jet printers (Trade Name: BC-01, available from Canon Inc.) and applied to the substrate. Then, dots 4-1 and 4-2 of Pt and PdO were produced by heating the applied inks at 300° C. in the atmosphere for 10 minutes.

Step 3

The electron-emitting devices were placed in a vacuum apparatus having a configuration as schematically illustrated in FIG. 8 and the inside of the vacuum chamber was evacuated to a pressure level of $1.3\times10^{-4}$ Pa before applying a pulse voltage to them to carry out an energization forming process as in the case of Example 1.

Step 4

Then, acetone was introduced into the vacuum chamber through a gas feed line to produce a pressure of $1.3\times10^{-1}$ Pa. Then, an activation process was carried out by applying a rectangular pulse voltage having a wave height of 18V, a pulse width of 100 μsec. and a pulse interval of 100 msec. to each pair of device electrodes. The application of the pulse voltage was terminated when fluorescent light was observed, indicating that the increase of the device current got to a saturation level 30 minutes after the start of the activation process. The inside of the vacuum chamber was evacuated again.

Step 5

The vacuum chamber was continuously evacuated, heating the chamber by means of a heater to maintaining the temperature to 200° C. until the pressure fell to $2.7\times10^{-5}$ Pa in 10 hours, when the heater was turned off to gradually cool the vacuum chamber.

Each of the prepared electron-emitting devices was tested for electron emission by applying a rectangular pulse voltage having a wave height of 16V. The device and the anode were separated by a distance of 4 mm and the anode voltage was 1 kV.

After completing the test on all the devices, it was found that the Ie of the electron-emitting devices showed a dispersion of 7%. When observed through an SEM after the test, it was also found that an electron-emitting region had been formed along the corresponding edge of the device electrode 3 in each device.

Comparative Example 4

In this example, electron-emitting devices were prepared by following the steps of Example 8 except all the dots were produced simply by means of Ink D. The prepared electron-emitting devices were tested in a similar manner. The Ie of the electron-emitting devices showed a dispersion of 14%. When observed through an SEM after the test, it was found that the electron-emitting region was largely meandering in each device as in the case of Comparative Example 1.

Example 9

In this example, the following electroconductive film producing inks were used.

Ink D: Same as Ink A (PAME)

Ink E: An aqueous solution obtained by dissolving a 1.28 g of palladium acetate-bis(N-butylethanolamine) (PADBE) into a 12 g of water (metal concentration of 2 wt %).

The thermal decomposition process of the two inks were preliminarily observed by heating them in the atmosphere. The PAME was decomposed to produce metal palladium at or around 170° C. and started producing PdO at 280° C., whereas the PADBE started decomposition at or around 145° C. to produce metal palladium and totally turned into PdO at 255° C.

Metal Pd is supposed to become PdO at a same temperature regardless of the starting material. The reason for the above difference in the temperature of producing PdO may lie in the fact that the metal Pd earlier produced from the starting Pd compound of one of the inks is subjected to a heat-treatment for a longer period than the metal Pd produced later from the Pd compound of the other ink and that the metal Pd from one of the inks and the metal Pd from the other ink probably were microscopically different from each other and therefore showed different reaction speeds.

A plurality of pairs of device electrodes of Au were formed on a thoroughly washed and dried quartz substrate. The device electrodes of each pair were separated from each other by 20 μm.

Four dots 4-1 of Ink E and also four dots 4-2 of ink D were formed between the device electrodes of each pair as in Example 8 and then subjected to a heat-treatment at 270° C. for 10 minutes to produce an electroconductive film 4. In this example, the four dots of each ink were arranged along a line perpendicular to a line connecting the device electrodes so that any adjacent dots partly overlapped each other. In other words, the dots were arranged substantially similarly to those of FIG. 2A.

Thereafter, they were subjected to an energization forming process and an activation process as in Example 8, although the pressure of acetone was held to $1\times10^{-2}$ Pa and the wave height of the applied pulse voltage was raised from 0V to 14V at a rate of 5 V/min. and then held to 14V.

After evacuating the vacuum chamber for 10 hours, maintaining the temperature to 200° C., the heater was turned off to gradually cool the vacuum chamber.

The prepared devices were tested for the performance of electron emission to obtain a result similar to that of Example 8. When observed through an SEM after the test, it was found that the electron-emitting region had been produced along the corresponding edge of the device electrode 3 in each device as in the case of Example 8.

Example 10

In this example, the following electroconductive film producing inks were used.

Ink D: Same as Ink A (PAME)

Ink F: An aqueous solution obtained by dissolving a 0.84 g of palladium acetate-di(N-butylethanolamine) (PABE) into a 12 g of water.

In a heat-treatment conducted in the atmosphere, it was found that the PABE was decomposed at 145° C. to produce metal Pd, all of which turned into PdO at 245° C.

Each of the electron-emitting devices prepared in this example had a configuration substantially the same as that of FIG. 3A. In other words, the film dots of the center column were formed by Ink F, whereas the dots of the other columns were formed by Ink D. As in the case of Example 8, each dot was formed by means of an ink-jet apparatus, heat-treated at 260° C. in the atmosphere for 10 minutes. Subsequently, they were subjected to energization forming and activation processes and then placed in a vacuum chamber to test the electron-emitting performance thereof, evacuating the vacuum chamber in order to realize an elevated degree of vacuum. The obtained result was similar to that of Example 8.

After the test, each device was observed through an SEM to find that an electron-emitting region had been formed substantially at the center of the electroconductive film.

Example 11

Each of the electron-emitting devices prepared in this example had a configuration substantially the same as their counterparts of Example 9.

In this example, the following electroconductive film producing inks were used.

Ink G: An aqueous solution obtained by dissolving palladium acetate-monobutanolamine (PAMB) into water to show a metal concentration of 2 wt %.

Ink H: An aqueous solution obtained by dissolving palladium acetate-bis(N,N-diethylethanolamine) (PADEE) into water to show a metal concentration of 2 wt %.

In a heat-treatment conducted in the atmosphere to see the thermal decomposition of the palladium compounds, it was found that the PAMB was decomposed at or around 180° C. to produce metal Pd, which turned into PdO at 260° C., whereas the PADEE was decomposed at 140° C. to produce metal Pd, which turned into PdO at 230° C.

Electron-emitting devices were prepared as in Example 9 by heat-treating them to produce electroconductive films at 240° C. in the atmosphere for 10 minutes. After energization forming and activation processes, they were put into a vacuum chamber, which was then evacuated to see the electron-emitting performance.

The result of the test was similar to that of Example 9. When observed through an SEM, the devices were found to be similar to their counterparts of Example 9.

Example 12

The devices prepared in this example were similar to those of Example 10. In this example, the following electroconductive film producing inks were used.

Ink I: An aqueous solution obtained by dissolving palladium acetate-monopropanolamine (PAMP) into water to show a metal concentration of 2 wt %.

Ink J: An aqueous solution obtained by dissolving palladium acetate-bis(N,N-dimethylethanolamine) (PADEE) into water to show a metal concentration of 2 wt %.

By looking into the thermal decomposition behavior of the inks, it was found that the PAMP was decomposed to produce metal Pd at or around 180° C. and turned into PdO at 270° C. On the other hand, the PADME was decomposed to produce metal Pd at 120° C. and turned into PdO at 230° C. Electron-emitting devices were prepared as in Example 10 and heat-treated at 240° C. in the atmosphere for 10 minutes. After carrying out energization forming and activation processes as in Example 9, the devices are placed in a vacuum chamber, which was then evacuated to see the electron-emitting performance of the devices.

The obtained result was similar to that of Example 9. When observed through an SEM, the devices were found to be similar to their counterparts of Example 9.

Example 13

A pattern of paired device electrodes were formed on a thoroughly washed quartz substrate by offset printing using platinum resinate paste and dried at 70° C. Thereafter, they were baked at about 580° C. to produce a plurality of pairs of device electrodes made of Pt.

Subsequently, a 1 wt % aqueous suspension of furnace black (HAF, average particle size-30 nm) which is fine carbon particles (containing additionally a surface active agent by 0.1 wt % to improve the dispersibility) was loaded into an ink-jet apparatus and applied in drops to the substrate to bridge each pair of device electrodes. The dispersed solution of fine carbon particles was attracted and slightly absorbed by the device electrodes that had been formed by baking the paste. Thereafter, the solution was dried at 100° C. for 10 minutes.

Subsequently, Ink K obtained by dissolving palladium acetate monoethanolamine (PAME) into a solution containing water by 70 wt % and isopropanol (IPA)+ethylene glycol+polyvinyl alcohol (PVA) by 30 wt % to a metal concentration of 1 wt % was applied to the substrate by means of an ink-jet apparatus and baked at 300° C. for 10 minutes. Under this condition, the Pd atoms located in the vicinity of the device electrodes each device where carbon particles were existent were not oxidized and remained as metal Pd because of the reducing effect of carbon. On the other hand, the Pd atoms located in the central area of the gap separating the device electrodes were oxidized to become PdO because sufficient carbon particles were not there. The PdO in the central area had a resistivity greater than that of the metal Pd near the device electrodes and produced a compositional latent image.

After carrying out energization forming and activation processes in a vacuum chamber as in Example 8, the devices are placed in a vacuum chamber, which was then evacuated to a high degree of vacuum to see the electron-emitting performance of the devices. The Ie of the electron-emitting devices showed a dispersion of 6%. When observed through an SEM, the electron-emitting region of each device was found in the middle of the gap separating the device electrodes with very little meandering. A Example 14

The steps of Examples 13 were followed except that a soda-lime glass substrate was used and the carbon fine particles were replaced by platinum carbon fine particles, that had been prepared by causing carbon fine particles with an average particles size of 30 nm to adsorb platinum chloride, drying them and reducing at 700° C. for 4 hours.

Subsequently, drops of Ink K were applied to the substrate and baked to produce a electroconductive film having a compositional latent image for each device as in Example 13 and, thereafter, the devices were subjected to energization forming and activation processes. The Ie of the electron-emitting devices showed a dispersion of 5%. The result of observation through an SEM was similar to that of Example 13.

Example 15

A quartz substrate was used in the example and device electrodes or Au were produced by photolithography.

The following electroconductive film producing inks were used.

Ink L: An aqueous solution obtained by dissolving nickel (II) acetate into water to show a metal concentration of 2 wt %.

Ink M: An aqueous solution obtained by dissolving chromium (III) acetate into water to show a metal concentration of 2 wt %.

Step 1

Devices, each having a configuration as schematically shown in FIGS. 6A and 6B, were prepared. Referring to FIGS. 6A and 6B, dot 4-1 and dot 4-2 were formed respectively by Inks L and M. The ink discharging operation was so controlled that the dot 4-1 had a metal Ni film thickness of 40 nm and the dot 4-2 had a metal Cr film thickness of 10 nm.

Step 2

The devices were heat treated at 400° C. for 10 minutes in an atmosphere where a mixture gas containing Ar by 98% and $H_2$ by 2% was flowing to decompose the metal compounds into respective filmy metals. Thereafter, the temperature was raised to 500° C., which was maintained for 1 hour and then gradually lowered in order to produce an alloy of Ni and Cr at the intersecting area of the dots in each device.

Step 3

The devices were subjected to energization forming and activation processes as in Example 8 and the devices are placed in a vacuum chamber at 200° C., which was then evacuated to a high degree of vacuum.

The prepared devices were tested for electron-emitting performance as in Example 8 to find a dispersion of 11% in the Ie of the electron-emitting devices. When observed through an SEM, it was found that a slightly meandering electron-emitting region had been formed at the intersecting area of the two dots in each device.

The electron-emitting region meandering to such a slight extent may be attributable to the fact that the alloy of Ni 80% and Cr 20% represents a typical chromium alloy composition and shows a resistivity greater than that of Ni or Cr, by a magnitude of three digits, so that it may vigorously generate heat when electrically energized in an energization forming process to produce an electron-emitting region only there. Metal Cr and metal Ni respectively have a bcc crystal structure and an fcc crystal structure and the alloy with the above composition shows a structure resembling to that of Ni and therefore it may be same to presume that the interface of the alloy and the metal Cr is mechanically not strong. In other words, the interface of the alloy and the metal Cr may trigger the formation of an electron-emitting region in the energization forming process.

Advantages of the Invention

As described above in detail, an electroconductive thin film having a structural or compositional latent image can be produced by a method of manufacturing an electron-emitting device according to the invention and using an ink-jet apparatus. With the method of the present invention, the electron-emitting region that is produced in the electroconductive thin film in the subsequent energization forming process can be positionally controlled to locate it at a desired position, be it in the middle of the gap separating the device electrodes or close to one of the device electrodes, and the meandering of the electron-emitting region can be minimized so that the prepared electron-emitting devices may operate uniformly for electron emission. Additionally, if the device electrodes of each of the electron-emitting device are separated from each other by a large gap in an image-forming apparatus that is comprised of the devices, a small bright spot can be formed on the fluorescent film juxtaposed in the image-forming apparatus by the electron beam emitted from the electron-emitting device. Therefore, such an image-forming apparatus is highly ad adapted to displaying finely defined images. Still additionally, the display screen of the image-forming apparatus will be free from uneven brightness to further improve the quality of the images displayed on the screen.

Finally, the use of an ink-jet apparatus broadens the choice of materials that can be used for producing electroconductive thin film for the purpose of the invention if compared with any known techniques for producing latent images.

For example, when a configuration similar to that of Example 1 is to be prepared by a patterning method which does not utilize the ink jet technique, the following steps would be carried out. That is to say, a thinner one of the films is first formed and patterned, and thereafter, a patterning mask for the other thicker one of the films is formed over the thinner film already formed and patterned, followed by application of an organic metal solution, then baking and lift-off operation for patterning. Since the above patterning mask is formed over the thinner film previously formed, the thinner film must have a fairly good adhesion to the substrate. In case the film material is an oxide such as PdO as in Example 1, such a good adhesion would be expected and therefore, the above steps would be successfully carried out. Also, in case the film material is metal Pd, patterning of a PdO film followed by reduction would successfully provide a desired film pattern. However, in case of using Pt as a film material, the above steps could not be adopted since oxidation of Pt is very difficult. Contrary to this, appropriate organic Pt compounds may by used for pattern formation using the ink jet technique.

In addition, in the case of preparing a configuration, such as that of Example 15, the reason why alloying of the intersecting area of the dots can be easily carried out at a relatively lower temperature appears that the two dots lie one upon another in their oxide forms and the alloying occurs upon thermal decomposition. If, on the other hand, the above alloying is to be effected by the conventional process using repeated film formation and patterning, for example, a NiO film must be first formed and patterned and then, after formation of a Cr film and reduction of NiO to Ni, the intersecting area must be subjected to alloying. In this case, at the intersecting area, Ni and Cr are piled as metal layers, sufficient diffusion must be ensured for alloying, thus requiring a time-consuming, high-temperature treatment, which is not always possible in light of heat resistance of the substrate.

What is claimed is:

1. A method of manufacturing an electron-emitting device having a pair of device electrodes formed on a substrate, an electroconductive film connecting the device electrodes, and an electron-emitting region formed in the electroconductive film, characterized in that the method comprises the steps of:

(1) applying an ink containing the material for producing said electroconductive film to a predetermined position of the substrate in the form of one or more drops, by means of an ink-jet apparatus;

(2) drying and/or baking the applied drop(s) to turn the drop(s) into an electroconductive thin film; and (3) applying a voltage to the pair of device electrodes to cause an electric current to flow through said electroconductive film and produce an electron-emitting region;

said steps (1) and (2) being so conducted that the electroconductive film formed by said steps (1) and (2) has a latent image apt to produce an electron-emitting region by the Joule's heat generated by the step (3), wherein said latent image is a structural latent image formed in an area that produces a high current density when the electric current is made to flow through the electroconductive film in said step (3), and wherein said latent image is formed in an area of the electroconductive film between the device electrodes having a film thickness smaller than the rest of the electroconductive film.

2. A method of manufacturing an electron-emitting device according to claim 1, wherein said area of the electroconductive film having a smaller film thickness is formed for a latent image by using inks containing the material of the electroconductive film to different concentrations respectively for the area and the rest of the electroconductive film, and the ink containing the material at a higher concentration is applied to the area for producing a greater film thickness in the form of one or more than one drops, whereas the ink containing the material at a lower concentration is applied to the area(s) for producing a smaller film thickness in the form of one or more than one drops.

3. A method of manufacturing an electron-emitting device according to claim 3, wherein said area of the electroconductive film having a smaller film thickness is formed for a latent image by differentiating the number of times of applying an ink containing the material of the electroconductive thin film between said area and the remaining area(s), and the ink is applied to said remaining area(s) for a number of times greater than the number of times of applying the ink to said area.

4. A method of manufacturing an electron-emitting device according to any of claims 1 through 3, wherein said ink is or said inks are applied in the form of dots, and the ratio of the thickness of the film dot(s) for producing a greater film thickness to the thickness of the film dot(s) for producing a smaller film thickness is equal to or greater than 2.

5. A method of manufacturing an electron-emitting device having a pair of device electrodes formed on a substrate, an electroconductive film connecting the device electrodes, and an electron-emitting region formed in the electroconductive film, characterized in that the method comprises the steps of:

(1) applying an ink containing the material for producing said electroconductive film to a predetermined position of the substrate in the form of one or more drops, by means of an ink-jet apparatus;

(2) drying and/or baking the applied drop(s) to turn the drop(s) into an electroconductive thin film; and (3) applying a voltage to the pair of device electrodes to cause an electric current to flow through said electroconductive film and produce an electron-emitting region;

said steps (1) and (2) being so conducted that the electroconductive film formed by said steps (1) and (2) has a latent image apt to produce an electron-emitting region by the Joule's heat generated by the step (3), wherein said latent image is a structural latent image formed in an area that produces a high current density when the electric current is made to flow through the electroconductive film in said step (3), and wherein said latent image is formed by applying a drop or drops of the ink to form a film dot in such a way that the center of the film dot is displaced from the center line of the gap separating the device electrodes and the width $w_1$ of the film dot covering the related edge of one of the device electrodes is greater than the width $w_2$ of the film dot covering the related edge of the other device electrode to produce a latent image along the edge of the device electrode with the smaller covered width $w_2$.

6. A method of manufacturing an electron-emitting device according to claim 5, wherein the ratio of said widths of the dot is expressed by formula below $$w_1/w_2 \geqq 2.$$

7. A method of manufacturing an electron-emitting device according to claim 6, wherein, when said dot is substantially circular having a radius of R and the device electrodes are separated by a gap of L, the center of said dot being displaced from the center line of the gap by δL, the formula below is satisfied, $$\sqrt{\frac{R^2 - \left(\frac{L}{2} - \delta L\right)^2}{R^2 - \left(\frac{L}{2} + \delta L\right)^2}} \geq 2.$$

8. A method of manufacturing an electron-emitting device having a pair of device electrodes formed on a substrate, an electroconductive film connecting the device electrodes, and an electron-emitting region formed in the electroconductive film, characterized in that the method comprises the steps of:

(1) applying an ink containing the material for producing said electroconductive film to a predetermined position of the substrate in the form of one or more drops, by means of an ink-jet apparatus;

(2) drying and/or baking the applied drop(s) to turn the drop(s) into an electroconductive thin film; and (3) applying a voltage to the pair of device electrodes to cause an electric current to flow through said electroconductive film and produce an electron-emitting region;

said steps (1) and (2) being so conducted that the electroconductive film formed by said steps (1) and (2) has a latent image apt to produce an electron-emitting region by the Joule's heat generated by the step (3), wherein said latent image is a structural latent image formed in an area that produces a high current density when the electric current is made to flow through the electroconductive film in said step (3), and wherein said latent image is produced in a portion of the electroconductive film that is made of a material having a resistivity greater than the material of the rest of the electroconductive film connecting the device electrode.

9. A method of manufacturing an electron-emitting device according to claim 8, wherein said portion of the electroconductive film is made of a metal oxide and the rest of the electroconductive film is made of a metal.

10. A method of manufacturing an electron-emitting device according to claim 9, wherein said portion made of a metal oxide is formed by applying an ink containing a compound of a first metal element and said rest of the electroconductive thin film is formed by applying an ink containing a compound of a second metal element, said first metal element being apt to be more oxidized than said second metal element.

11. A method of manufacturing an electron-emitting device according to claim 10, wherein said first metal element is Pd and said second metal element is Pt.

12. A method of manufacturing an electron-emitting device according to claim 9, wherein said portion of the electroconductive film made of a metal oxide and having a greater resistivity is formed by applying an ink containing a first metal compound in the form of a drop or drops whereas the rest of the electroconductive film made of a metal is formed by applying another ink containing a second metal compound in the form of a drop or drops, said first metal compound having a thermal decomposition temperature lower than said second metal compound.

13. A method of manufacturing an electron-emitting device according to claim 12, wherein said first metal compound is selected from palladium acetate-bis(N-butylethanolamine), palladium acetate-di(N-butylethanolamine), palladium acetate-bis(N,N-diethylethanolamine) and palladium acetate-bis(N,N-dimethylethanolamine) and said second metal compound is selected from palladium acetate-monoethanol amine, palladium acetate-monobutanol amine and palladium acetate-monopropanol amine.

14. A method of manufacturing an electron-emitting device according to claim 9, wherein a reducing substance is disposed in a portion of the area for forming the electroconductive film and the metal compound containing ink is applied to the area in the form of drops and baked to produce the metal of the metal compound on the portion carrying said reducing substance and the oxide of the metal on the rest of the area.

15. A method of manufacturing an electron-emitting device according to claim 14, wherein said reducing substance is carbon in the form of fine particles.

16. A method of manufacturing an electron-emitting device according to claim 14, wherein said reducing substance is platinum carbon in the form of fine particles.

17. A method of manufacturing an electron-emitting device according to any of claims 14 through 16, wherein a suspension containing fine particles of said reducing substance in a dispersed state is applied to said portion by means of an ink-jet apparatus.

18. A method of manufacturing an electron-emitting device according to claim 8, wherein said electroconductive film is formed by a dot of a first metal and a dot of a second metal in such a way that an alloy of the metals is produced on the overlapping (intersecting) area of the dots and shows a resistivity greater than that of either of the metals by a magnitude of double digits so that a latent image is formed in the intersecting area.

19. A method of manufacturing an electron-emitting device according to claim 18, wherein said first and second metals are respectively Ni and Cr and nichrome is produced in the intersecting area.

20. A method of manufacturing an electron-emitting device having a pair of device electrodes formed on a substrate, an electroconductive film between the device electrodes and an electron-emitting region formed in the electroconductive film, said method comprising a step in which an electroconductive film for forming an electron-emitting region is produced by applying one or more drops of a solution containing the material of the electroconductive film to an area between the device electrodes and a step of producing an electron-emitting region in the electroconductive film formed from the applied solution, characterized in that said drops are applied to form a plurality of dots at different locations in the area between the device electrodes, and the amount of the material of the electroconductive film is different between at least part of the dots at different locations.

21. The method according to claim 20, wherein the difference in the applied amount is realized by applying drops of the solution with varied concentrations of the material of the electroconductive film.

22. The method according to claim 20, wherein the difference in the applied amount is realized by controlling the number of times of applying drops of the solution to each location.

23. A method of manufacturing an electron-emitting device having a pair of device electrodes formed on a substrate, an electroconductive film between the device electrodes and an electron-emitting region formed in the electroconductive film, said method comprising a step in which an electroconductive film for forming an electron-emitting region is produced by applying one or more drops of a solution containing the material of the electroconductive film to an area between the device electrodes and a step of producing an electron-emitting region in the electroconductive film formed from the applied solution, characterized in that said drops are applied to form a plurality of dots at different locations in the area between the device electrodes, and the composition of the applied solution is different between at least part of the dots at different locations.

24. The method according to claim 23, wherein the difference in the composition of the applied solution is realized by applying drops of solutions of different metals to different locations.

25. The method according to claim 24, wherein the different metals have different oxidizabilities.

26. The method according to claim 24, wherein the different metals produce an alloy with each other.

27. The method according to claim 23, wherein the difference in the composition of the applied solution is realized by applying drops of solutions of different compounds to different locations.

28. The method according to claim 27, wherein the different compounds have different thermal decomposabilities.

29. The method according to claim 27, wherein one of the different compounds is a reducing agent.

30. A method of manufacturing an electron-emitting device having a pair of device electrodes formed on a substrate, an electroconductive film between the device electrodes and an electron-emitting region formed in the electroconductive film, said method comprising a step in which an electroconductive film for forming an electron-emitting region is produced by applying one or more drops of a solution containing the material of the electroconductive film to an area between the device electrodes and a step of producing an electron-emitting region in the electroconductive film formed from the applied solution, characterized in that said drops are applied to form a dot with its center located as biased to either one of the device electrodes.

31. The method according to claim 30, wherein the electroconductive film formed from the applied solution has widths at the corresponding edges of the device electrodes, one of the widths being greater than the other by two times or more.

32. A method of manufacturing an electron source comprising a substrate, a plurality of electron-emitting devices arranged on the substrate, each having a pair of oppositely disposed device electrodes, an electroconductive film connecting the device electrodes and an electron-emitting region formed in an area of the electroconductive film, and wires connecting the electron-emitting devices, characterized in that the electron-emitting devices are formed by a method according to any of claims 20 through 31.

33. A method of manufacturing an image-forming apparatus comprising an electron source, prepared by arranging a plurality of electron-emitting devices, each having a pair of oppositely disposed device electrodes, an electroconductive film connecting the device electrodes and an electron-emitting region formed in an area of the electroconductive film, and wires connecting the electron-emitting devices on an substrate and an image-forming member adapted to emit light when irradiated with electron beams emitted from the electron source, said electron source and said image-forming member being arranged in a vacuum envelope, characterized in that the electron source is formed by a method according to claim 32.

* * * * *

UNITED STATES PATENT AND TRADEMARK OFFICE

CERTIFICATE OF CORRECTION

PATENT NO. : 6,017,259

DATED : January 25, 2000

INVENTOR(S) : TAIKO MOTOI, ET AL.

It is certified that error appears in the above-identified patent and that said Letters Patent is hereby corrected as shown below:

ON THE TITLE PAGE:

[56] References Cited, under FOREIGN PATENT DOCUMENTS:

"1112633" should read --1-112633--;
"2247940" should read --2-247940--;
"7235255" should read --7-235255--; and
"7325279" should read --7-325279--; and under *Attorney, Agent, or Firm*:

"Fitzpatrick, Cella Harper & Scinto" should read --Fitzpatrick, Cella, Harper & Scinto--.

COLUMN 1:

Line 24, "Advance" should read --Advances--.

COLUMN 6:

Line 46, "tens of several" should read --several tens of--.

COLUMN 9:

Line 19, "tens of several" should read --several tens of--;

UNITED STATES PATENT AND TRADEMARK OFFICE

CERTIFICATE OF CORRECTION

PATENT NO. : 6,017,259

DATED : January 25, 2000

INVENTOR(S) : TAIKO MOTOI, ET AL.

It is certified that error appears in the above-identified patent and that said Letters Patent is hereby corrected as shown below:

COLUMN 9: (cont.)

Line 21, "hundreds of several" should read --several hundreds of--;
Line 25, "tens of several" should read --several tens of--;
Line 39, "factors and" should read --factors, and is--;
Line 40, "hundreds of several" should read --several hundreds of--; and "is" should read --several--;
Line 41, "several" should be deleted; and
Line 57, "except" should read --except in the case of--.

COLUMN 10:

Line 5, "hundreds" should read --several hundreds of--;
Line 6, "of several picometers and hundreds of several" should read --picometers and several hundreds of--;
Line 61, "hundreds of" should read --several hundreds of--; and
Line 62, "several picometers and tens of several" should read --picometers and several tens of--.

COLUMN 12:

Line 32, "greater than" should read --as great as--; and
Line 67, "$(w_1/w_2)=\geq 2$," should read --$(w_1/w_2)\geq 2$,--.

UNITED STATES PATENT AND TRADEMARK OFFICE

CERTIFICATE OF CORRECTION

PATENT NO. : 6,017,259

DATED : January 25, 2000

INVENTOR(S) : TAIKO MOTOI, ET AL.

It is certified that error appears in the above-identified patent and that said Letters Patent is hereby corrected as shown below:

COLUMN 13:

Line 25, "hardily oxidizable metal" should read --metal that is difficult to oxidize--.

COLUMN 14:

Line 44, "tens of several" should read --several tens of--.

COLUMN 15:

Line 17, "carbonic" should read --carboxylic--; and
Line 29, "Ie" should read --If--.

COLUMN 16:

Line 12, "same" should read --the same--;
Line 32, "same" should read --the same--;
Line 45, "re" should be deleted; and
Line 51, "KV" should read --kV--.

COLUMN 17:

Line 40, "relative" should read --relatively--.

COLUMN 18:

Line 16, "electron" should read --electrons--;
Line 26, "an" should read --a--; and
Line 64, "same" should read --the same--.

UNITED STATES PATENT AND TRADEMARK OFFICE

CERTIFICATE OF CORRECTION

PATENT NO. : 6,017,259

DATED : January 25, 2000

INVENTOR(S) : TAIKO MOTOI, ET AL.

It is certified that error appears in the above-identified patent and that said Letters Patent is hereby corrected as shown below:

COLUMN 21:

Line 12, "ad 64 respectively deneotes" should read --and 64 respectively denote--.

COLUMN 22:

Line 18, "S1" should read--S1--;
Line 23, "S1" should read--S1--; and
Line 43, "form" should read --from--.

COLUMN 23:

Line 19, "so far" should read --as far--; and
Line 37, "ad" should be deleted.

COLUMN 24:

Line 50, "bd" should be deleted.

COLUMN 26:

Line 32, "is" should read --was--; and
Line 47, "an" should read --a--.

COLUMN 28:

Line 17, "same" should read --the same--.

UNITED STATES PATENT AND TRADEMARK OFFICE

CERTIFICATE OF CORRECTION

PATENT NO. : 6,017,259

DATED : January 25, 2000

INVENTOR(S) : TAIKO MOTOI, ET AL.

It is certified that error appears in the above-identified patent and that said Letters Patent is hereby corrected as shown below:

COLUMN 29:

Line 1, "to" should be deleted;
Line 3, "were having" should read --having--; and
Line 10, "same" should read --similar--.

COLUMN 30:

Line 2, "maintaining" should read --maintain--;
Line 36, "into a" should read --in--; and
Line 37, "were" should read --was--.

COLUMN 31:

Line 23, "into a" should read --in--.

COLUMN 32:

Line 34, "were" should read --was--; and
Line 56, "each device" should read --in each device--.

COLUMN 33:

Line 1, "are" should read --were--;
Line 14, "particles" should read --particle--; and
Line 56, "are" should read --were--.

COLUMN 34:

Line 7, "to" should be deleted--;

UNITED STATES PATENT AND TRADEMARK OFFICE

CERTIFICATE OF CORRECTION

PATENT NO. : 6,017,259

DATED : January 25, 2000

INVENTOR(S) : TAIKO MOTOI, ET AL.

It is certified that error appears in the above-identified patent and that said Letters Patent is hereby corrected as shown below:

COLUMN 34: (cont.)

Line 8, "same to presume" should read--presumed--;
Line 28, "device" should read --devices--; and
Line 34, "ad" should be deleted.

COLUMN 40:

Line 13, "an" (first occurrence) should read--a--.

Signed and Sealed this

Seventeenth Day of April, 2001

*Attest:*

Nicholas P. Godici

NICHOLAS P. GODICI

*Attesting Officer*

*Acting Director of the United States Patent and Trademark Office*